US012552625B2

(12) United States Patent
Hyodo et al.

(10) Patent No.: US 12,552,625 B2
(45) Date of Patent: Feb. 17, 2026

(54) SHEET CONVEYANCE APPARATUS AND IMAGE FORMING SYSTEM

(71) Applicant: CANON KABUSHIKI KAISHA, Tokyo (JP)

(72) Inventors: Taisuke Hyodo, Shizuoka (JP); Shinya Noda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 18/316,849

(22) Filed: May 12, 2023

(65) Prior Publication Data

US 2023/0406659 A1 Dec. 21, 2023

(30) Foreign Application Priority Data

May 19, 2022 (JP) ..... 2022-082096

(51) Int. Cl.
*B65H 5/36* (2006.01)
*B65H 5/06* (2006.01)
(Continued)

(52) U.S. Cl.
CPC ..... *B65H 5/36* (2013.01); *B65H 5/066* (2013.01); *B65H 29/125* (2013.01); *B65H 29/58* (2013.01);
(Continued)

(58) Field of Classification Search
CPC . B65H 5/066; B65H 5/36; B65H 5/38; B65H 29/12; B65H 29/125; B65H 29/145;
(Continued)

(56) References Cited

U.S. PATENT DOCUMENTS

2008/0296834 A1* 12/2008 Matsubara ..... B65H 29/58 271/225
2011/0081185 A1* 4/2011 Motoi ..... B65H 29/60 399/407
(Continued)

FOREIGN PATENT DOCUMENTS

JP H03200663 A 9/1991
JP 2009-190832 A 8/2009
(Continued)

*Primary Examiner* — Prasad V Gokhale
(74) *Attorney, Agent, or Firm* — Canon U.S.A., Inc. IP Division

(57) ABSTRACT

A sheet conveyance apparatus includes first and second conveyance paths, a conveyance roller pair, first and second conveyance guides, and a holding unit. The reverse unit reverses a sheet having passed through the first conveyance path. The second conveyance path conveys the sheet having passed through the first conveyance path between the reverse unit and the first conveyance path. The conveyance roller pair nips and convey the reversed sheet. The first conveyance guide forms the second conveyance path and the second conveyance guide forms the second conveyance path. The holding unit moveably holds the first conveyance guide. The first conveyance guide moves between a first position located at a first distance from the second conveyance guide and a second position located at a second distance. The sheet reversed by the reverse unit is conveyed toward the conveyance roller pair by the first conveyance guide located at the first position.

11 Claims, 21 Drawing Sheets

(51) Int. Cl.
*B65H 29/12* (2006.01)
*B65H 29/58* (2006.01)
*B65H 85/00* (2006.01)

(52) U.S. Cl.
CPC ... *B65H 85/00* (2013.01); *B65H 2301/33312* (2013.01); *B65H 2403/41* (2013.01); *B65H 2403/942* (2013.01); *B65H 2404/144* (2013.01); *B65H 2404/1521* (2013.01); *B65H 2404/63* (2013.01); *B65H 2801/27* (2013.01)

(58) Field of Classification Search
CPC ..... B65H 29/58; B65H 29/60; B65H 85/00; B65H 2301/33312; B65H 2403/41; B65H 2403/942; B65H 2404/144; B65H 2404/1441; B65H 2404/152; B65H 2404/1521; B65H 2404/6112; B65H 2404/63; B65H 2404/631; B65H 2404/632; B65H 2801/27
See application file for complete search history.

(56) References Cited

U.S. PATENT DOCUMENTS

| | | | | |
|---|---|---|---|---|
| 2013/0140764 | A1* | 6/2013 | Samoto | B65H 7/02 271/225 |
| 2016/0159596 | A1* | 6/2016 | Yamada | G03G 21/1647 271/225 |
| 2022/0204303 | A1* | 6/2022 | Sato | B65H 37/04 |

FOREIGN PATENT DOCUMENTS

| | | | |
|---|---|---|---|
| JP | 2015020823 | A | 2/2015 |
| JP | 2021095291 | A | 6/2021 |

* cited by examiner

SHEET CONVEYANCE APPARATUS AND IMAGE FORMING SYSTEM

BACKGROUND

Field

The present disclosure relates to a sheet conveyance apparatus that conveys a sheet, and an image forming system that forms an image on the sheet.

Description of the Related Art

An image forming apparatus, such as an electrophotographic multifunction peripheral, is optionally provided with a sheet processing apparatus that performs processing, such as binding processing and sorting processing, on sheets each having an image formed thereon in a main body of the image forming apparatus. Japanese Patent Application Laid-Open No. 2021-095291 discusses a mechanism that is provided with a non-return flapper to prevent a sheet from moving backward when the sheet is reversed in a buffer processing portion. This non-return flapper is rotatable and is urged in one direction by a spring. When a sheet comes into contact with the non-return flapper, the non-return flapper moves against the force of the spring.

SUMMARY

According to an aspect of the present disclosure, a sheet conveyance apparatus includes a first conveyance path for receiving a sheet, a reverse unit configured to reverse the sheet having passed through the first conveyance path, a second conveyance path for conveying the sheet having passed through the first conveyance path between the reverse unit and the first conveyance path, a conveyance roller pair configured to nip and convey the sheet reversed on the second conveyance path by the reverse unit, a first conveyance guide located between the reverse unit and the conveyance roller pair, wherein the first conveyance guide forms the second conveyance path, a second conveyance guide located at a position opposing the first conveyance guide between the reverse unit and the conveyance roller pair, wherein the second conveyance guide forms the second conveyance path, and a holding unit configured to hold the first conveyance guide in a movable manner, wherein the first conveyance guide is configured to move between a first position located at a first distance from the second conveyance guide and a second position located at a second distance greater than the first distance, and wherein the sheet reversed by the reverse unit is conveyed toward the conveyance roller pair by the first conveyance guide located at the first position.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings.

Figure 1:
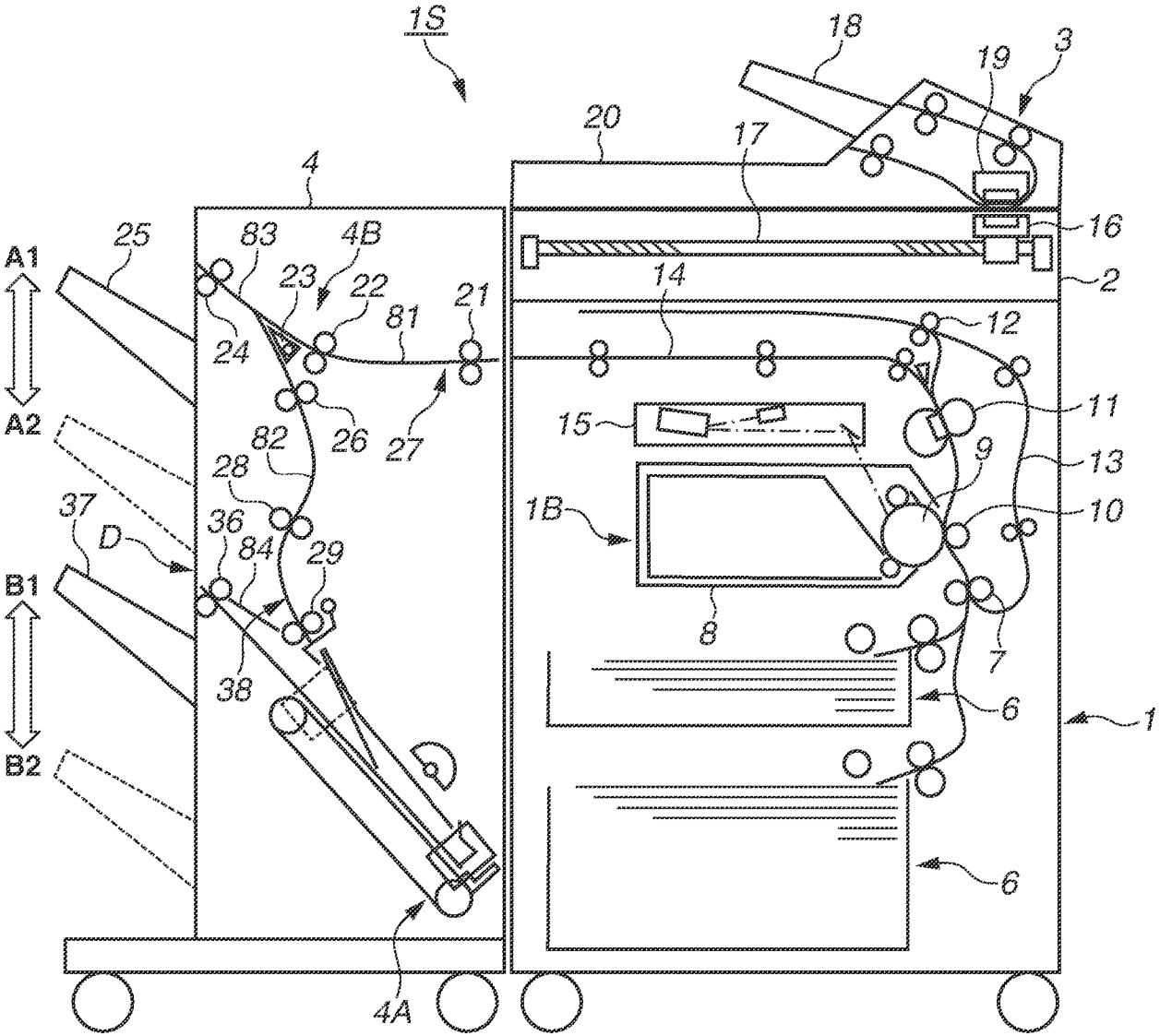
FIG. 1 is a schematic view illustrating an image forming system according to a first exemplary embodiment.

FIG. 1 is a schematic view of an image forming system 1S according to a first exemplary embodiment. The image forming system 1S according to the first exemplary embodiment includes an image forming apparatus 1, an image reading apparatus 2, a document feeding apparatus 3, and a post-processing apparatus 4 functioning as a sheet conveyance apparatus. The image forming system 1S forms an image on a sheet serving as a recording material, and outputs the sheet after performing processing on the sheet by the post-processing apparatus 4 as necessary. A brief description of operation of each apparatus will be given, and then the post-processing apparatus 4 will be described in detail.

The document feeding apparatus 3 conveys a document placed on a document tray 18 to image reading portions 16 and 19. The image reading portions 16 and 19 are image sensors that read image information from a document surface. The both surfaces of the document are read at a time when the document is conveyed once. The document on which image information is read is discharged to a document discharge portion 20. The image reading apparatus 2 can read image information from a still document set on a platen glass by reciprocating the image reading portion 16 by a driving apparatus 17. Examples of the still document include a booklet that cannot be fed by the document feeding apparatus 3.

The image forming apparatus 1 is an electrophotographic apparatus including an image forming portion 1B that employs a direct transfer method. The image forming portion 1B includes a cartridge 8 including a photosensitive drum 9, and a laser scanner unit 15 that is located above the cartridge 8. In the case of performing an image forming operation, the surface of the rotating photosensitive drum 9 is charged and the laser scanner unit 15 exposes the photosensitive drum 9 to light based on the image information, thereby forming an electrostatic latent image on the surface of the photosensitive drum 9. The electrostatic latent image carried on the surface of the photosensitive drum 9 is developed into a toner image by using charged toner particles, and the toner image is conveyed to a transfer portion where the photosensitive drum 9 and the transfer roller 10 face each other. A controller (printer control unit 1000 to be described below) of the image forming apparatus 1 causes the image forming portion 1B to perform the image forming operation based on image information read by the image reading portions 16 and 19 or image information received via a network from an external computer.

The image forming apparatus 1 includes a plurality of feeding apparatuses 6 that feed sheets as recording materials one by one at predetermined intervals. A skew of each sheet fed from the feeding apparatuses 6 is corrected by registration rollers 7, and then the sheet is conveyed to the transfer portion and the toner image carried on the surface of the photosensitive drum 9 is transferred onto the sheet at the transfer portion. A fixing unit 11 is located downstream of the transfer portion in a sheet conveyance direction. The fixing unit 11 includes a rotary member pair that nips and conveys the sheet, and a heat generating member such as a halogen lamp for heating the toner image, and performs image fixing processing on the toner image formed on the sheet by heating and pressurizing the toner image.

In the case of discharging the sheet having an image formed thereon to the outside of the image forming apparatus 1, the sheet that has passed through the fixing unit 11 is conveyed to the post-processing apparatus 4 through a horizontal conveyance portion 14. After an image is formed on a first surface of the sheet in double-sided printing, the sheet that has passed through the fixing unit 11 is delivered to reverse rollers 12 and switched back by the reverse rollers 12. Then, the sheet passes through a re-conveyance portion 13 and is conveyed to the registration rollers 7 again. After that, an image is formed on a second surface of the sheet while the sheet passes through the transfer portion and the fixing unit 11 again, and then the sheet is conveyed to the post-processing apparatus 4 through the horizontal conveyance portion 14.

The above-described image forming portion 1B is an example of an image forming unit that forms an image on a sheet. An electrophotographic unit that employs an intermediate transfer method to transfer a toner image formed on a photosensitive member onto a sheet via an intermediate transfer member may also be used. A printing unit that employs an inkjet method or an offset printing method may be used as the image forming unit.

Post-Processing Apparatus

The post-processing apparatus 4 includes a binding processing portion 4A that performs binding processing on sheets. The post-processing apparatus 4 performs binding processing on the sheets received from the image forming apparatus 1, and discharges the sheets as a sheet bundle. The post-processing apparatus 4 may simply discharge the sheets received from the image forming apparatus 1, without performing binding processing on the sheets.

The post-processing apparatus 4 includes a receiving path 81, an internal discharge path 82, a first discharge path 83, and a second discharge path 84 as conveyance paths through which sheets are conveyed. The post-processing apparatus 4 also includes an upper discharge tray 25 and a lower discharge tray 37 as sheet discharge destinations. The upper discharge tray 25 functions as a first stacking unit and the lower discharge tray 37 functions as a second stacking unit. The receiving path 81 is a first conveyance path according to the present exemplary embodiment through which sheets received from the image forming apparatus 1 are conveyed. The internal discharge path 82 is a third conveyance path according to the present exemplary embodiment through which sheets are conveyed toward the binding processing portion 4A. The first discharge path 83 is a second conveyance path through which sheets are discharged onto the upper discharge tray 25 and the sheet reversed by reverse rollers 24 is conveyed to the internal discharge path 82.

The second discharge path 84 is a conveyance path (fourth conveyance path) through which sheets are discharged onto the lower discharge tray 37.

Inlet rollers 21, pre-buffer rollers 22, and an inlet sensor 27 are located on the receiving path 81. Reverse rollers 24 functioning as a reverse unit are located on the first discharge path 83.

Internal discharge rollers 26, intermediate conveyance rollers 28, kicking-out rollers 29, and a pre-intermediate stacking sensor 38 are located on the internal discharge path 82. Bundle discharge rollers 36 are located on the second discharge path 84. The inlet sensor 27 and the pre-intermediate stacking sensor 38 are examples of a sheet detection unit that detects the passage of a sheet at a predetermined detection position on the corresponding conveyance path in the post-processing apparatus.

As the inlet sensor 27 and the pre-intermediate stacking sensor 38, optical sensors that detect the presence or absence of a sheet at the detection position using light as described below can be used.

Each sheet conveyance path in the post-processing apparatus 4 will be described below. A buffering operation in a buffer portion 4B including the reverse rollers 24 and the detailed configuration and operation of the binding processing portion 4A will be described below.

A sheet discharged from the horizontal conveyance portion 14 in the image forming apparatus 1 is received by the inlet rollers 21, and is then conveyed toward the pre-buffer rollers 22 through the receiving path 81. The inlet sensor 27 detects the sheet at the detection position between the inlet rollers 21 and the pre-buffer rollers 22. The pre-buffer rollers 22 convey the sheet received from the inlet rollers 21 toward the first discharge path 83. The first discharge path 83 extends upward to allow the sheet discharged from the receiving path 81 to reach the reverse rollers 24, and also extends below the receiving path 81 to allow the sheet reversed by the reverse rollers 24 to reach the internal discharge rollers 26.

At a predetermined timing after the passage of the trailing edge of the sheet is detected by the inlet sensor 27, the sheet conveyance speed of the pre-buffer rollers 22 is accelerated to a speed higher than the sheet conveyance speed of the horizontal conveyance portion 14. The sheet conveyance speed of the inlet rollers 21 may be set to be higher than the sheet conveyance speed of the horizontal conveyance portion 14, and the sheet conveyance speed of the inlet rollers 21 located upstream of the pre-buffer rollers 22 may be accelerated. In this case, a one-way clutch may be desirably installed between conveyance rollers of the horizontal conveyance portion 14 and a motor that drives the conveyance rollers so that the conveyance rollers can run idle even if the sheet is pulled by the inlet rollers 21.

If the upper discharge tray 25 is set as the sheet discharge destination, the reverse rollers 24 discharge the sheet received from the pre-buffer rollers 22 onto the upper discharge tray 25. In this case, the reverse rollers 24 are decelerated to a predetermined discharge speed at a predetermined timing after the trailing edge of the sheet has passed through the pre-buffer rollers 22.

If the lower discharge tray 37 is set as the sheet discharge destination, the reverse rollers 24 switches back the sheet received from the pre-buffer rollers 22, and then conveys the sheet to the internal discharge path 82.

A non-return valve 23 is located at a branch portion where the receiving path 81 and the internal discharge path 82 are branched from the first discharge path 83 on the upstream side of the reverse rollers 24 in the direction in which the sheet is discharged by the reverse rollers 24. The non-return valve 23 includes a function of preventing the sheet switched back by the reverse rollers 24 from moving backward to the receiving path 81.

The internal discharge rollers 26, the intermediate conveyance rollers 28, and the kicking-out rollers 29 located on the internal discharge path 82 sequentially convey the sheet received from the reverse rollers 24 toward the binding processing portion 4A. The pre-intermediate stacking sensor 38 detects the sheet between the intermediate conveyance rollers 28 and the kicking-out rollers 29.

The binding processing portion 4A includes a stapler functioning as a binding unit according to the present exemplary embodiment. After a plurality of sheets received from the internal discharge path 82 is aligned, and the sheet bundle is bound at a predetermined position by the stapler. The sheet bundle bound by the binding processing portion 4A is delivered to the bundle discharge rollers 36 through the second discharge path 84 functioning as the fourth conveyance path, and is discharged onto the lower discharge tray 37 by the bundle discharge rollers 36 functioning as a discharge unit. The post-processing apparatus 4 also includes a discharge portion D that is an opening for discharging the sheet conveyed in the discharge direction by the bundle discharge rollers 36 to the outside of the post-processing apparatus 4 from the inside of the post-processing apparatus 4.

The upper discharge tray 25 and the lower discharge tray 37 are configured to move up and down with respect to a housing of the post-processing apparatus 4. The post-processing apparatus 4 includes sheet surface detection sensors that detect a sheet top surface position (height of stacked sheets) on the upper discharge tray 25 and the lower discharge tray 37. When the sheet is detected by one of the sheet surface detection sensors, the corresponding tray is caused to descend in an A2 or B2 direction. When the removal of the sheet from the upper discharge tray 25 or the lower discharge tray 37 is detected by the sheet surface detection sensor, the corresponding tray is caused to ascend in an A1 or B1 direction. Accordingly, the upper discharge tray 25 and the lower discharge tray 37 are controlled to ascend or descend so that the top surface of the stacked sheets can be maintained at a constant level.

Buffering Operation

Figure 2:
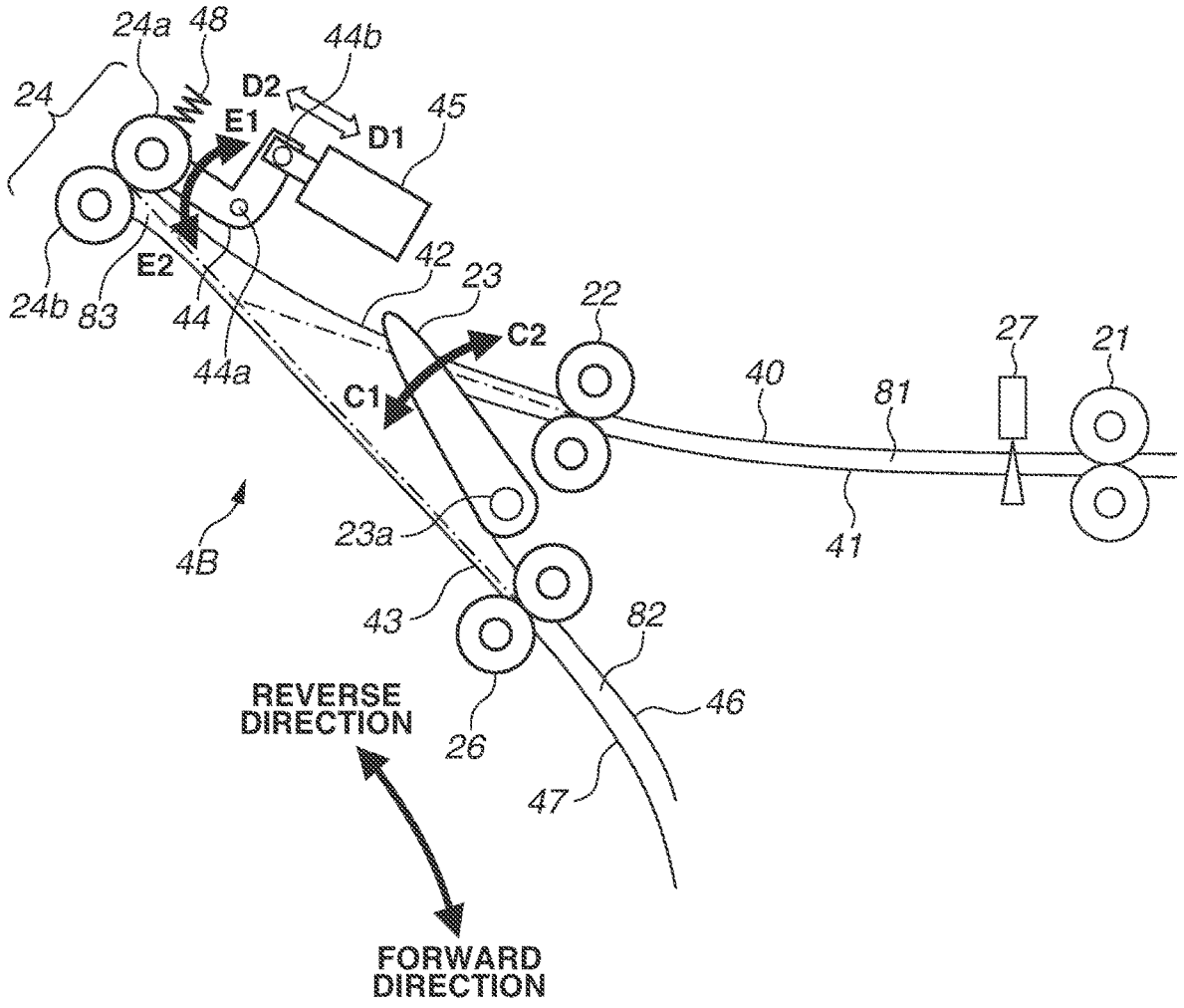
FIG. 2 is a schematic view illustrating a buffer portion according to the first exemplary embodiment.

Next, the buffering operation will be described in detail with reference to FIGS. 2 to 4D. FIG. 2 is a schematic view illustrating the buffer portion 4B. FIGS. 3A to 4D each illustrate the buffering operation.

As illustrated in FIG. 2, the buffer portion 4B includes the reverse rollers 24 (reverse roller pair), the non-return valve 23, and the internal discharge rollers 26 (intermediate roller pair). The inlet rollers 21, the pre-buffer rollers 22, and the inlet sensor 27 located on the receiving path 81 are also involved in the buffering operation.

Conveyance guides that form a sheet conveyance path (part of the receiving path 81) between the inlet rollers 21 and the pre-buffer rollers 22 are hereinafter referred to as an "inlet upper guide 40" and an "inlet lower guide 41".

Conveyance guides that form a sheet conveyance path (part of the internal discharge path 82) between the internal discharge rollers 26 and the intermediate conveyance rollers 28 are hereinafter referred to as an "internal discharge upper guide 46" and an "internal discharge lower guide 47". A conveyance guide that guides a sheet from the same side of the inlet upper guide 40 between the pre-buffer rollers 22 and the reverse rollers 24 is referred to as a "reverse upper guide 42". A conveyance guide that guides a sheet from the same side of the internal discharge lower guide 47 between the reverse rollers 24 and the internal discharge rollers 26 is referred to as a "reverse lower guide 43".

The sheet conveyed by the inlet rollers 21 is guided to the pre-buffer rollers 22 by the inlet upper guide 40 and the inlet lower guide 41. The inlet upper guide 40 is provided with the inlet sensor 27. As the inlet sensor 27, a reflection-type photosensor that radiates infrared light toward the receiving path 81 and detects reflected light from the sheet to determine the presence or absence of the sheet at the detection position can be used. In this case, a hole having a size equal to or larger than the diameter of spot light of the inlet sensor 27 is formed in the inlet lower guide 41 at a position opposing the inlet sensor 27 such that the infrared light is not reflected when the sheet is not passing through.

The non-return valve 23 is located at the portion downstream of the pre-buffer rollers 22 where the receiving path 81 and the internal discharge path 82 are branched from the first discharge path 83. The non-return valve 23 is rotatably supported about a rotational shaft 23*a* with respect to the internal discharge upper guide 46. The non-return valve 23 is constantly urged by a spring (not illustrated) in a C2 direction (clockwise direction in FIG. 2) against a position (position in FIG. 2) where the leading edge of the non-return valve 23 overlaps the reverse upper guide 42 as viewed along an axial direction (sheet width direction) of the rotational shaft 23*a*. The spring constant of the foregoing spring is set to such a value that allows, when the sheet delivered out from the pre-buffer rollers 22 comes into contact with the non-return valve 23, the non-return valve 23 to rotate in a C1 direction (counterclockwise direction in FIG. 2) against the urging force of the spring. Accordingly, the non-return valve 23 allows the passage of the sheet to be conveyed toward the reverse rollers 24 from the pre-buffer rollers 22. On the other hand, after the trailing edge of the sheet on the receiving path 81 has passed through the non-return valve 23, the non-return valve 23 rotates in the C2 direction to prevent the sheet from moving backward to the pre-buffer rollers 22 from the reverse rollers 24.

The reverse rollers 24 are composed of a reverse upper roller 24*a* and a reverse lower roller 24*b*.

In the present exemplary embodiment, a driving force is input to each of the reverse upper roller 24*a* and the reverse lower roller 24*b*, and the rotation of the reverse upper roller 24*a* and the rotation of the reverse lower roller 24*b* are constantly synchronized.

The reverse rollers 24 are configured to be brought into contact with each other and separated from each other by a plunger solenoid 45. Specifically, one end of a separation lever 44 is connected to a roller shaft of the reverse upper roller 24*a*, and the separation lever 44 is rotatably supported about a lever support-point shaft 44*a* with respect to the reverse upper guide 42. A solenoid connection shaft 44*b* provided at the other end of the separation lever 44 is coupled to a plunger of the plunger solenoid 45.

When power is supplied to the plunger solenoid 45, the plunger is attracted in a D1 direction by a magnetic force and the separation lever 44 is rotated in an E1 direction, thereby bringing the reverse rollers 24 into a separated state (state where a nip portion of the roller pair is open). When the supply of power to the plunger solenoid 45 is stopped, the reverse upper roller 24*a* is brought into contact with the reverse lower roller 24*b* by an urging force of a pressure spring 48 connected to the roller shaft of the reverse upper roller 24*a*, thereby bringing the reverse rollers 24 into a contact state (state where the nip portion is closed). At this time, the separation lever 44 is rotated in an E2 direction along with the movement of the reverse upper roller 24*a* and the plunger of the plunger solenoid 45 is moved in a D2 direction.

The internal discharge rollers 26 are a roller pair that is adjacent to the reverse rollers 24 in the sheet conveyance direction on the internal discharge path 82 and is configured to rotate forward or backward. Specifically, the internal discharge rollers 26 can convey the sheet in a sheet conveyance direction (forward direction on the internal discharge path 82) from the reverse rollers 24 toward the binding processing portion 4A and in a reverse direction from the binding processing portion 4A toward the reverse rollers 24.

Next, the buffering operation in the buffer portion 4B will be described in detail with reference to FIGS. 3A to 4D. The buffering operation is an operation in which a predetermined number of sheets forming a subsequent sheet bundle are brought into a standby state in the buffer portion 4B until binding processing on a preceding sheet bundle is completed in the binding processing portion 4A. The buffering operation enables the image forming system 1S to execute image forming jobs including binding processing without lowering the productivity (the number of output images per unit time) of the image forming apparatus 1.

To distinguish the sheets from each other, the sheets are hereinafter referred to as a "sheet S1", a "sheet S2", and a "sheet S3". The sheet S1, the sheet S2, and the sheet S3 are sequentially delivered from the image forming apparatus 1 to the post-processing apparatus 4 in this order. One of the edges of each sheet that first passes through the inlet rollers 21 in the sheet conveyance direction is referred to as a "first edge", and the other edge of each sheet that subsequently passes through the inlet rollers 21 is referred to as a "second edge". A sheet conveyance speed in the horizontal conveyance portion 14 in the image forming apparatus 1 is represented by V1, and a sheet conveyance speed obtained after the conveyance speed is accelerated in the post-processing apparatus 4 is represented by V2. The sheet conveyance direction in which the sheet is conveyed by the inlet rollers 21 is referred to as a first direction.

Figure 3A:
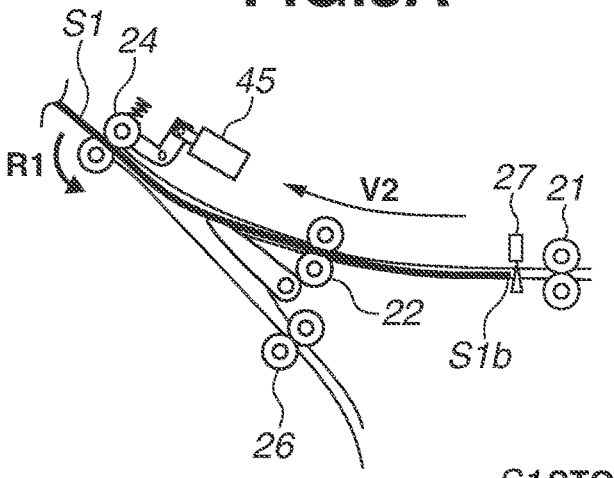
FIG. 3A illustrates a buffering operation according to the first exemplary embodiment.

FIG. 3A is a diagram illustrating a state where the trailing edge (second edge S1*b*) of the sheet S1 on the receiving path 81 has passed through the detection position of the inlet sensor 27. When the passage of the second edge S1*b* of the sheet S1 is detected by the inlet sensor 27, the pre-buffer rollers 22 and the reverse rollers 24 accelerate the conveyance speed of the sheet S1 from the speed V1 to the speed V2. The acceleration of the conveyance speed of the sheet S1 increases the interval between the sheet S1 and the subsequent sheet S2, thereby securing the sheet interval adequate for a reverse operation (switchback) performed by the reverse rollers 24. At the time point illustrated in FIG. 3A, the reverse rollers 24 are rotated in a rotation direction R1 corresponding to the conveyance direction before the reverse operation, and conveys the sheet S1 toward the upper discharge tray 25.

Figure 3B:
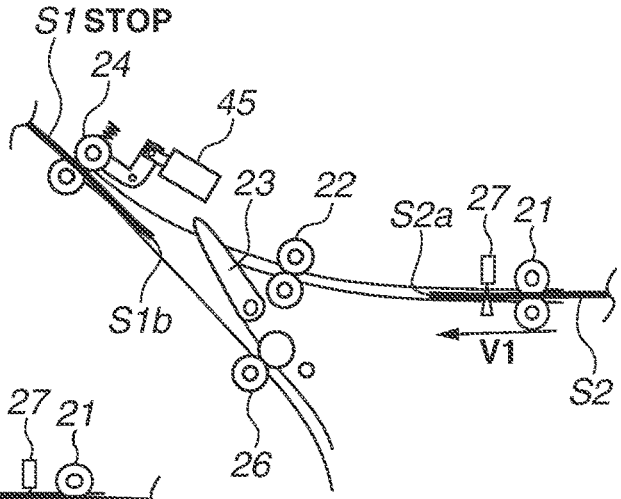
FIG. 3B illustrates the buffering operation according to the first exemplary embodiment.

FIG. 3B is a diagram illustrating a state where the trailing edge (second edge S1*b*) of the sheet S1 on the receiving path 81 has passed through the non-return valve 23. The rotation of the reverse rollers 24 is temporarily stopped at a predetermined timing after the trailing edge (second edge S1*b*) of the sheet S1 has passed through the non-return valve 23. The predetermined timing is determined based on an elapsed time from the timing when the passage of the trailing edge (second edge S1*b*) of the sheet S1 is detected by the inlet sensor 27.

Figure 3C:
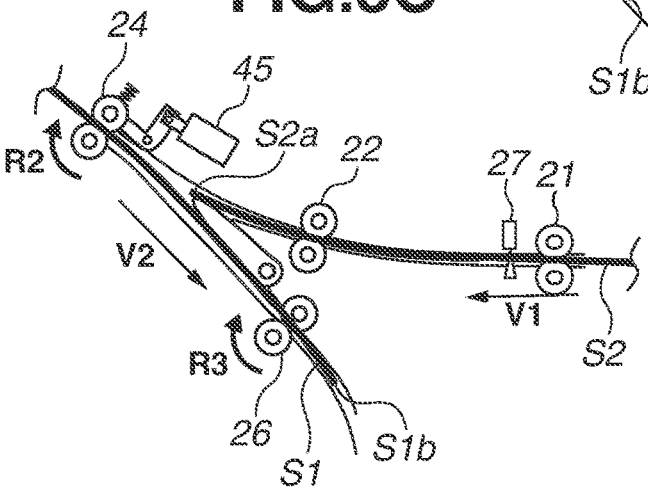
FIG. 3C illustrates the buffering operation according to the first exemplary embodiment.

FIG. 3C is a diagram illustrating a state where the reverse rollers 24 start to rotate in a rotation direction R2 corresponding to the rotation direction after the reverse operation, and deliver the sheet S1 to the internal discharge rollers 26. The sheet conveyance direction of the reverse rollers 24 at this time is referred to as a second direction that is opposite to the first direction.

The internal discharge rollers 26 receive the sheet S1 in a state where the internal discharge rollers 26 are rotating in a rotation direction R3, and convey the sheet S1 in the forward direction on the internal discharge path 82. After the leading edge (second edge S1*b*) of the sheet S1 on the internal discharge path 82 has passed through the position of the non-return valve 23, the leading edge (first edge S2*a*) of the sheet S2 on the receiving path 81 reaches the non-return valve 23. Accordingly, the sheet S1 and the sheet S2 are conveyed such that the sheets S1 and S2 pass each other at the branch portion of the conveyance path.

Figure 3D:
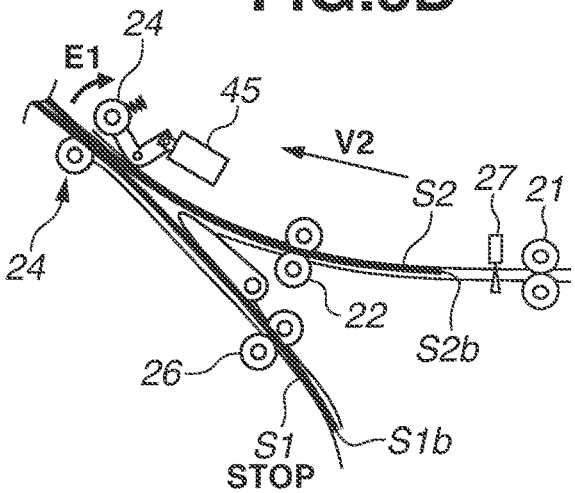
FIG. 3D illustrates the buffering operation according to the first exemplary embodiment.

FIG. 3D is a diagram illustrating a state where the leading edge (second edge S1*b*) of the sheet S1 on the internal discharge path 82 is conveyed by a predetermined amount from the internal discharge rollers 26 and the rotation of the internal discharge rollers 26 is temporarily stopped. After the time point illustrated in FIG. 3C, power is supplied to the plunger solenoid 45 before the leading edge (first edge S2*a*) of the sheet S2 on the receiving path 81 reaches the reverse rollers 24. This allows the reverse upper roller 24*a* to move in the E1 direction, thereby bringing the reverse rollers 24 into the separated state. The sheet S1 is held by the internal discharge rollers 26 that are stopped, and a part of the sheet S1 is located between the reverse rollers 24 that are in the separated state. Accordingly, the sheet S2 that is delivered from the receiving path 81 to the first discharge path 83 by the pre-buffer rollers 22 is conveyed such that the sheet S2 slides on the sheet S1. The conveyance speed of the sheet S2 is also accelerated from the speed V1 to the speed V2 by the pre-buffer rollers 22 after the passage of the trailing edge (second edge S2*b*) of the sheet S2 is detected by the inlet sensor 27.

Figure 4A:
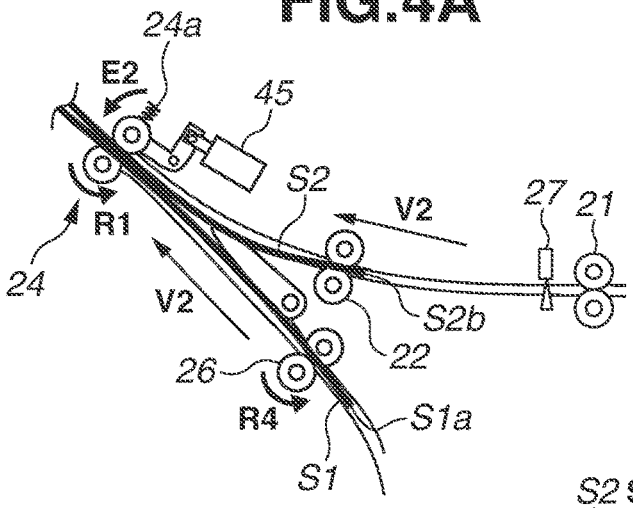
FIG. 4A illustrates a buffering operation according to the first exemplary embodiment.

FIG. 4A is a diagram illustrating a state after the internal discharge rollers 26 start to convey the sheet S1 in the reverse direction. The internal discharge rollers 26 start to rotate in a rotation direction R4 at the timing when the sheet S2 is conveyed to a predetermined position, and convey the sheet S1 in the reverse direction toward the reverse rollers 24. A target speed of the internal discharge rollers 26 is set to the speed V2, like the pre-buffer rollers 22. The supply of power to the plunger solenoid 45 is stopped at a timing after the conveyance speed of the sheet S1 becomes substantially equal to the conveyance speed of the sheet S2 (relative speed is substantially zero). As a result, the reverse upper roller 24*a* is moved in the E2 direction and the reverse rollers 24 are brought into the contact state again, so that the sheets S1 and S2 are nipped by the reverse rollers 24 in a state where the sheets S1 and S2 are superimposed. The reverse rollers 24 start to rotate in the rotation direction R1 in synchronization with the internal discharge rollers 26, and are controlled to rotate at a peripheral speed (speed V2) equal to that of the pre-buffer rollers 22 and the internal discharge rollers 26 before the state of the reverse rollers 24 is changed from the separated state to the contact state.

Figure 4B:
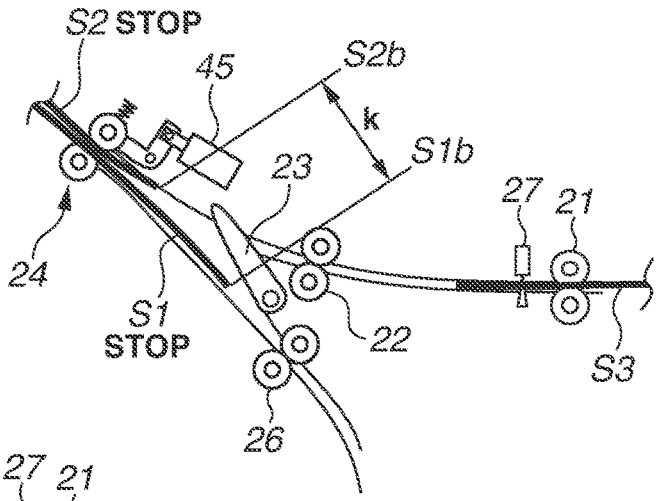
FIG. 4B illustrates a buffering operation according to the first exemplary embodiment.

FIG. 4B is a diagram illustrating a state after the trailing edge (second edge S2*b*) of the sheet S2 on the receiving path 81 has passed through the non-return valve 23. The rotation of the reverse rollers 24 is temporarily stopped at a predetermined timing after the trailing edge (second edge S2*b*) of the sheet S2 has passed through the non-return valve 23. At this time, the movement of the superimposed sheets S1 and S2 is stopped, while the second edge S1*b* protrudes by a predetermined shift amount k in the forward direction of the internal discharge path 82 with respect to the second edge S2*b* of the sheet S2. This shift amount k is controlled based on the predetermined timing at which the internal discharge rollers 26 start to convey the sheet S1 in the reverse direction as described above with reference to FIG. 4A.

Figure 4C:
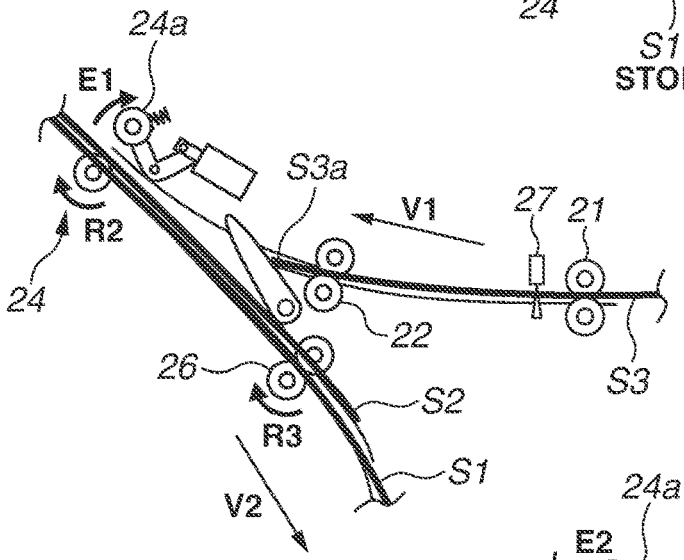
FIG. 4C illustrates a buffering operation according to the first exemplary embodiment.

FIG. 4C is a diagram illustrating a state where the reverse rollers 24 start to rotate in the rotation direction R2 and deliver the superimposed sheets S1 and S2 to the internal discharge rollers 26. The internal discharge rollers 26 receive the sheets S1 and S2 in a state where the internal discharge rollers 26 are rotating in the rotation direction R3, and convey the sheets S1 and S2 in the forward direction on the internal discharge path 82. The sheets S1 and S2 are conveyed in a superimposed state toward the binding processing portion 4A through the internal discharge path 82.

After the leading edge (second edge S2*b*) of the sheet S2 on the internal discharge path 82 has passed through the position of the non-return valve 23, the leading edge (first edge S3*a*) of the third sheet S3 on the receiving path 81 reaches the non-return valve 23. Accordingly, the sheet S2 and sheet S3 are conveyed such that the sheet S2 and sheet S3 pass each other at the branch portion of the conveyance path. After the sheet S2 is nipped by the internal discharge rollers 26, the reverse upper roller 24*a* is moved in the E1 direction and the reverse rollers 24 are brought into the separated state again to be ready for receiving the subsequent sheet S3.

Figure 4D:
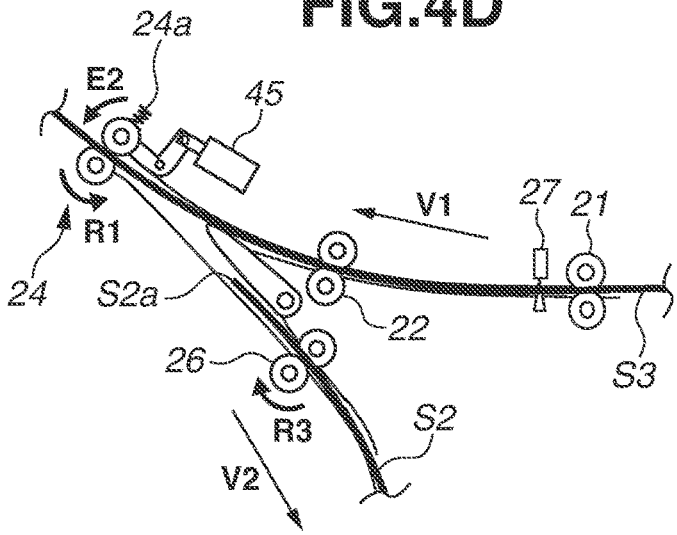
FIG. 4D illustrates a buffering operation according to the first exemplary embodiment.

FIG. 4D illustrates a state where the state of the reverse rollers 24 is changed from the separated state to the contact state. The state of the reverse rollers 24 is changed from the separated state to the contact state after the first edge S2*a* of the sheet S2 is separated from the reverse rollers 24, and then the reverse rollers 24 nip the sheet S3. After that, the reverse rollers 24 perform the reverse operation on the sheet S3 and convey the sheet S3 subsequent to the sheets S1 and S2 to the binding processing portion 4A through the internal discharge path 82.

A Case where Buffering Operation is Performed on Three or More Sheets

In the above-described present exemplary embodiment, the description is given of an example where the buffering operation is performed on the two sheets S1 and S2 at the buffer portion 4B as illustrated in FIGS. 3A to 4D, the buffer portion 4B according to the present exemplary embodiment may perform the buffering operation on three or more sheets. In this case, the internal discharge rollers 26 are stopped in a state where the internal discharge rollers 26 nip the sheets S1 and S2 as illustrated in FIG. 4C, and convey the sheets S1 and S2 in the reverse direction at a predetermined timing after the second edge of the third sheet S3 is detected by the inlet sensor 27. Then, the reverse rollers 24 are brought into the contact state after the conveyance speed of the internal discharge rollers 26 is synchronized with the conveyance speed of the pre-buffer rollers 22, thereby allowing the reverse rollers 24 to nip the three sheets S1, S2, and S2 in a superimposed state. At this time, the internal discharge rollers 26 start reverse feed of the sheets S1 and S2 at a predetermined timing, so that the second edge of the second sheet S2 protrudes by the predetermined shift amount k in the forward direction with respect to the second edge of the third sheet S3.

Opening and closing the nip portion of the reverse rollers 24 and the reverse operation of the internal discharge rollers 26 are repeatedly performed in an appropriate order, thereby enabling the buffer portion 4B to perform the buffering operation on, for example, at most five sheets. The buffering function of superimposing three or more sheets enables the post-processing apparatus 4 to execute processing on the sheets without lowering the productivity of the image forming apparatus 1, which contributes to an improvement in the productivity of the entire image forming system 15.

Roller Driving Control

Figure 5:
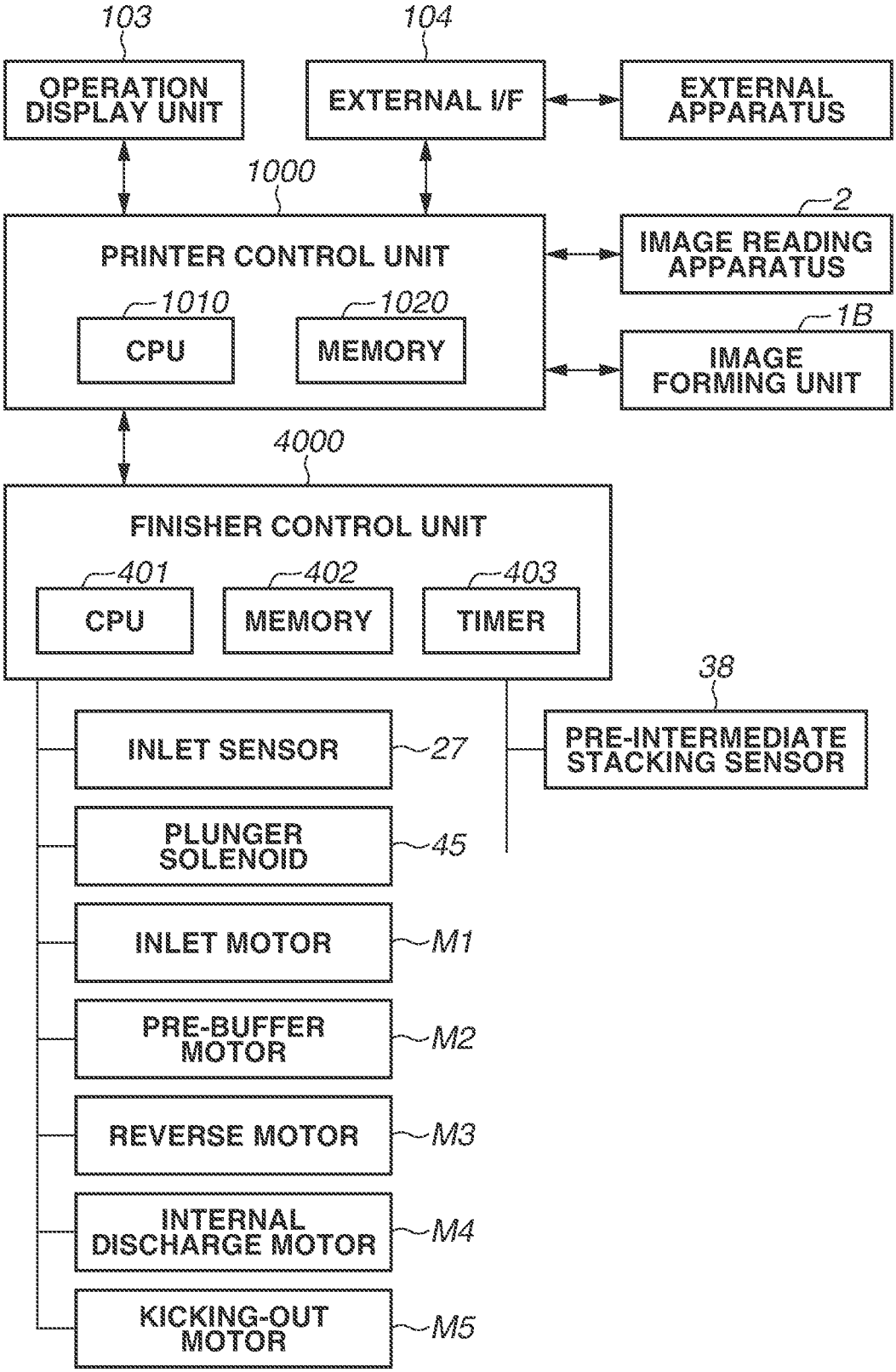
FIG. 5 is a block diagram illustrating a configuration example of the image forming system according to the first exemplary embodiment.

Next, a control configuration for implementing the operation described above with reference to FIGS. 3A to 4D will be described. FIG. 5 is a block diagram illustrating a configuration example of the image forming system 1S according to the present exemplary embodiment. The printer control unit 1000 is mounted on the image forming apparatus 1, and a finisher control unit 4000 is mounted on the post-processing apparatus 4. The printer control unit 1000 and the finisher control unit 4000 are interconnected via a communication interface and control the operation of the image forming system 15 in cooperation.

The printer control unit 1000 includes a central processing unit (CPU) 1010 and a memory 1020. The CPU 1010 reads out programs stored in the memory 1020 and executes the programs to control the image forming apparatus 1 in an integrated manner. For example, the CPU 1010 executes processing to cause the image forming portion 1B to execute an image forming operation, and processing to cause the image reading apparatus 2 to execute a reading operation to acquire image information. The memory 1020 includes a non-volatile storage medium such as a read-only memory (ROM), and a volatile storage medium such as a random access memory (RAM), and functions as a storage location where programs and data are stored, and a work space for the CPU 1010 to execute programs. The memory 1020 is an example of a non-transitory storage medium storing a program for controlling the image forming apparatus 1.

The printer control unit 1000 is connected to an external apparatus, such as a personal computer or a portable information device, via an external interface (I/F) 104, and receives commands to execute image forming jobs for the image forming system 15, and the like. The printer control unit 1000 is also connected to an operation display unit 103 that is a user interface of the image forming system 15. The operation display unit 103 includes a display apparatus such as a liquid crystal panel that presents information to a user, and an input apparatus such as physical buttons and a touch panel function unit of the liquid crystal panel to receive an input operation by the user.

The printer control unit 1000 communicates with the operation display unit 103 to control the display content of the display apparatus and receive information input via the input apparatus.

The finisher control unit 4000 includes a CPU 401, a memory 402, and a timer 403. The CPU 401 reads out programs stored in the memory 402 and executes the programs to control the post-processing apparatus 4 in an integrated manner. The memory 402 includes a non-volatile storage medium such as a ROM, and a volatile storage medium such as a RAM, and functions as a storage location where programs and data are stored, and a work space for the CPU 401 to execute programs. The memory 402 is an example of a non-transitory storage medium storing a program for controlling the post-processing apparatus 4.

The timer 403 is a circuit element including a clock function, and is implemented as an integrated circuit including a real-time clock (RTC) function, or a program module to be executed by the CPU 401. Not only the timer 403, but also the functions of the printer control unit 1000 and the finisher control unit 4000 may be implemented on a circuit of a control unit as independent hardware, such as an application-specific integrated circuit (ASIC), or may be implemented in a software manner as a program function unit. Some or all of the functions of the finisher control unit 4000 to be described below can be shared by the printer control unit 1000.

The post-processing apparatus 4 is provided with not only the inlet sensor 27, the pre-intermediate stacking sensor 38, the plunger solenoid 45, and the stapler, which are described above, but also a plurality of motors M1 to M5 each functioning as a drive source for conveying sheets, or a drive source for the binding processing portion 4A. Among the plurality of motors, the inlet motor M1 rotationally drives the inlet rollers 21. The pre-buffer motor M2 rotationally drives the pre-buffer rollers 22. The reverse motor M3 rotationally drives the reverse rollers 24. The internal discharge motor M4 rotationally drives the internal discharge rollers 26. The kicking-out motor M5 rotationally drives the kicking-out rollers 29. The foregoing rollers are driven independently by the respective motors M1 to M5, but instead may be controlled by a common motor, as long as the drive state of each roller can be appropriately controlled as described below.

An operation sequence of each roller will be described below with reference to flowcharts of FIGS. 6 to 9. Each step in the flowcharts is implemented when the CPU 401 of the finisher control unit 4000 executes a program read out from the memory 402. Each operation sequence is started when the finisher control unit 4000 receives, from the printer control unit 1000, a notification indicating that execution of an image forming job in which the lower discharge tray 37 is set as the sheet discharge destination is started.

In the following description, starting and stopping the rotation of each roller and changing a rotation speed of each roller indicate processing in which the CPU 401 sends a signal to instruct the rotation speed and rotation direction to a driving circuit of each of the motors M1 to M5. A "start timer", a "stop timer", and the like indicate functions of the timer 403 to count down a target processing execution time using a predetermined event occurrence time as a reference based on a preliminarily set standby period.

Operation Sequence of Inlet Rollers

Figure 6:
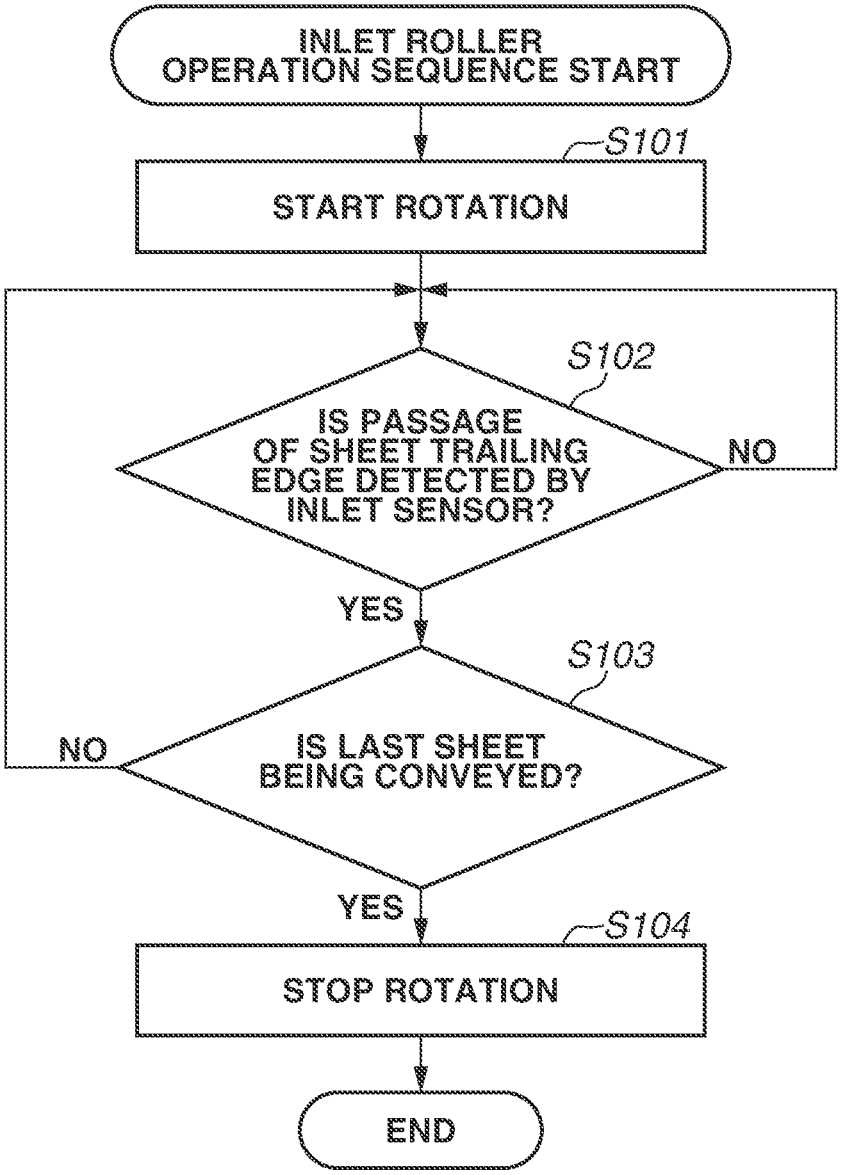
FIG. 6 is a flowchart illustrating an inlet roller operation sequence according to the first exemplary embodiment.

An operation sequence of the inlet rollers 21 will now be described with reference to FIG. 6.

In step S101, the rotation of the inlet rollers 21 is started at the target speed V1. In step S102, it is determined whether the passage of a sheet trailing edge on the receiving path 81 is detected by the inlet sensor 27 in the standby state. If the passage of the sheet trailing edge is detected by the inlet sensor 27 (YES in step S102), the processing proceeds to step S103. In step S103, it is determined whether the last sheet is being conveyed. If the last sheet is not being conveyed (NO in step S103), the processing returns to step S102 to continue the processing. If the last sheet is being conveyed (YES in step S103), the processing proceeds to step S104. In step S104, the rotation of the inlet rollers 21 is stopped to complete the operation sequence.

Operation Sequence of Pre-Buffer Rollers

Figure 7:
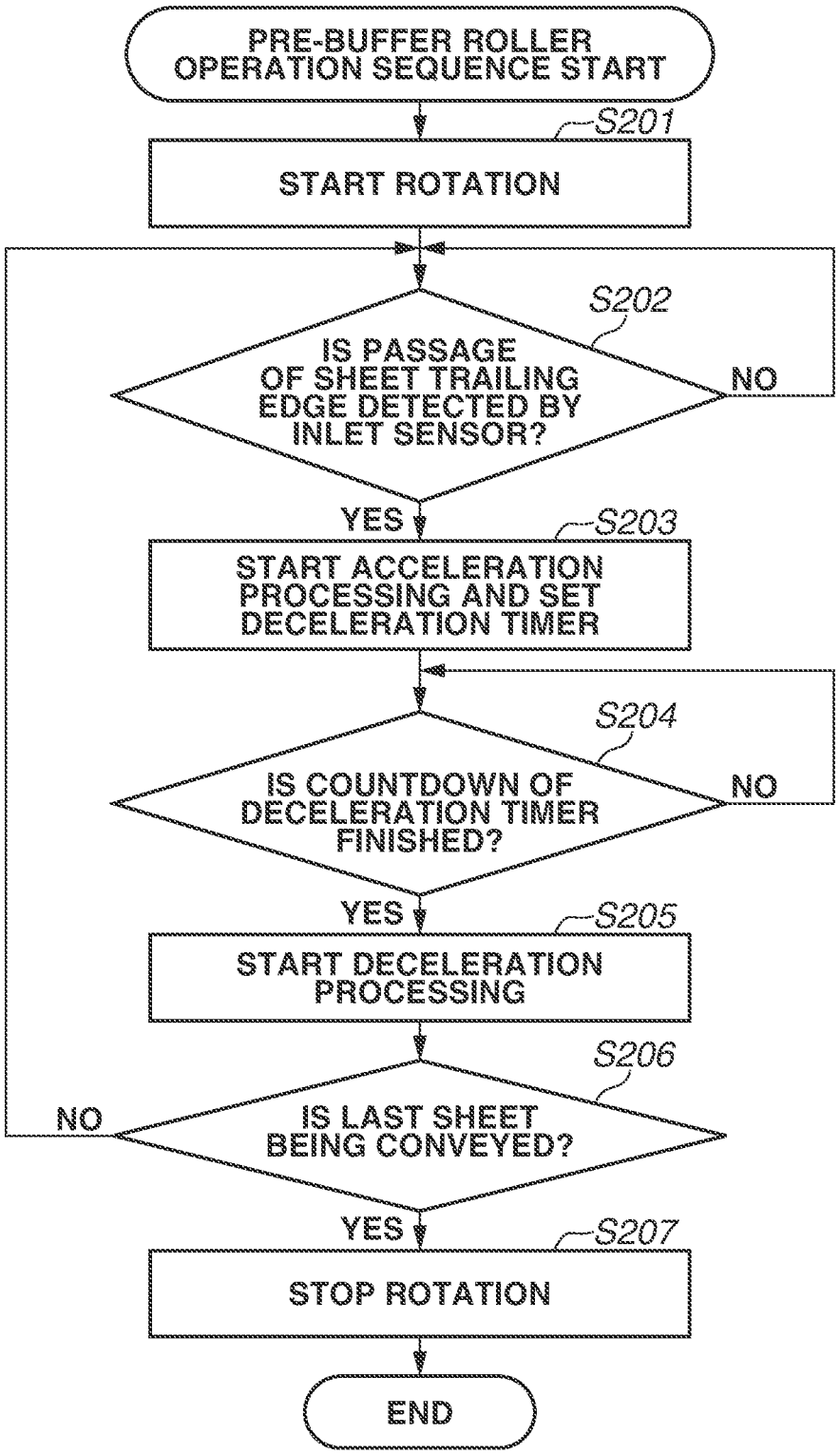
FIG. 7 is a flowchart illustrating a pre-buffer roller operation sequence according to the first exemplary embodiment.

Next, an operation sequence of the pre-buffer rollers 22 will be described with reference to FIG. 7.

In step S201, the rotation of the pre-buffer rollers 22 is started at the target speed V1. In step S202, it is determined whether the passage of a sheet trailing edge on the receiving path 81 is detected by the inlet sensor 27 in the standby state. If the passage of the sheet trailing edge is detected by the inlet sensor 27 (YES in step S202), the processing proceeds to step S203. In step S203, processing of accelerating the pre-buffer rollers 22 to the target speed V2 is started and a deceleration timer is set. An end time of the deceleration timer is set to a time when the sheet trailing edge passes through the pre-buffer rollers 22, or a timing after the time.

In step S204, countdown of the deceleration timer is performed in the standby state. If the countdown is finished (YES in step S204), the processing proceeds to step S205. In step S205, processing of decelerating the pre-buffer rollers 22 to the target speed V1 is started. In step S206, it is determined whether the last sheet is being conveyed. If the last sheet is not being conveyed (NO in step S206), the processing returns to step S202 to continue the processing. If the last sheet is being conveyed (YES in step S206), the processing proceeds to step S207. In step S207, the rotation of the pre-buffer rollers 22 is stopped to complete the operation sequence.

Operation Sequence of Reverse Rollers

Figure 8A:
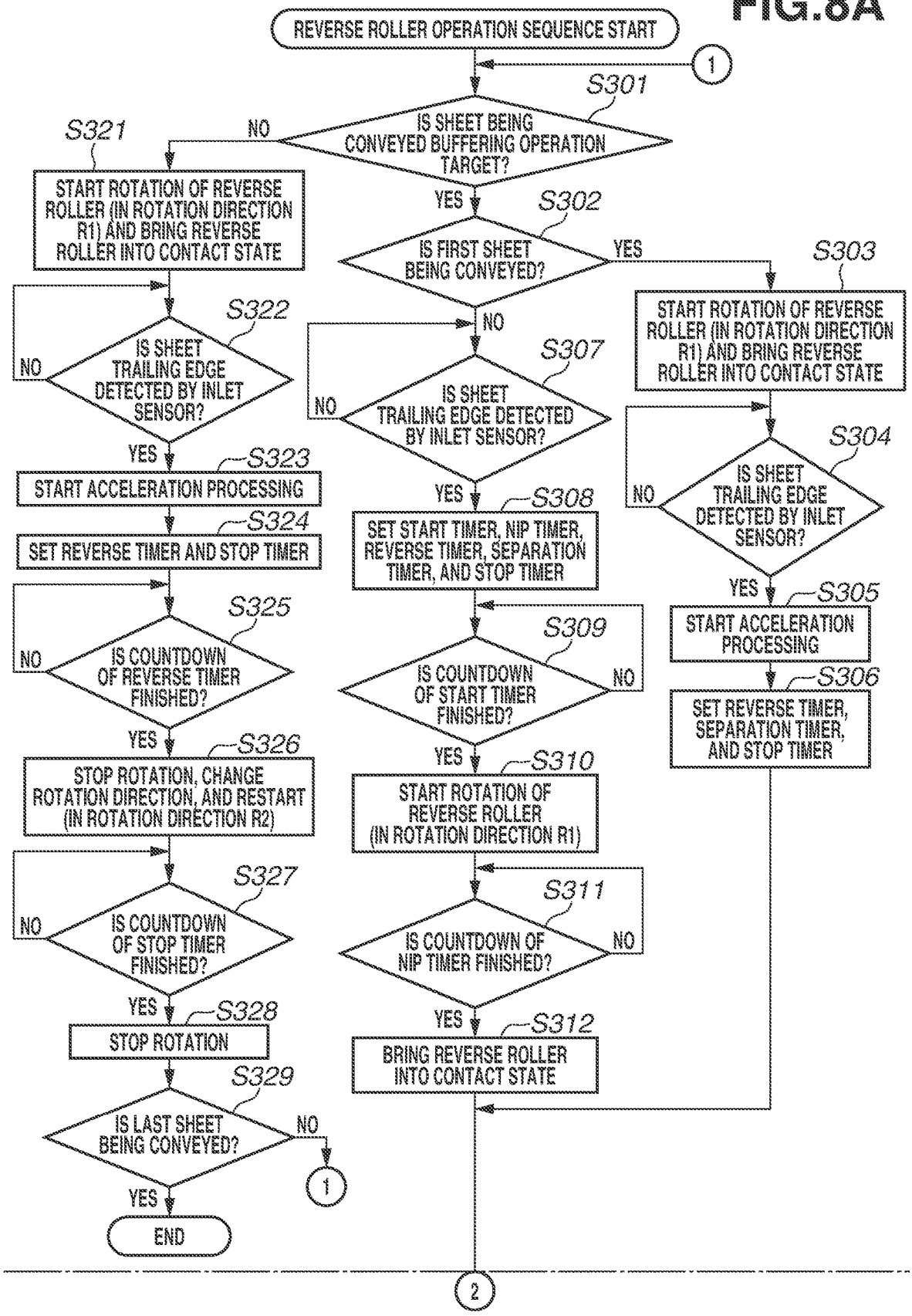
FIGS. 8A and 8B are a flowchart illustrating a reverse roller operation sequence according to the first exemplary embodiment.
Figure 8B:
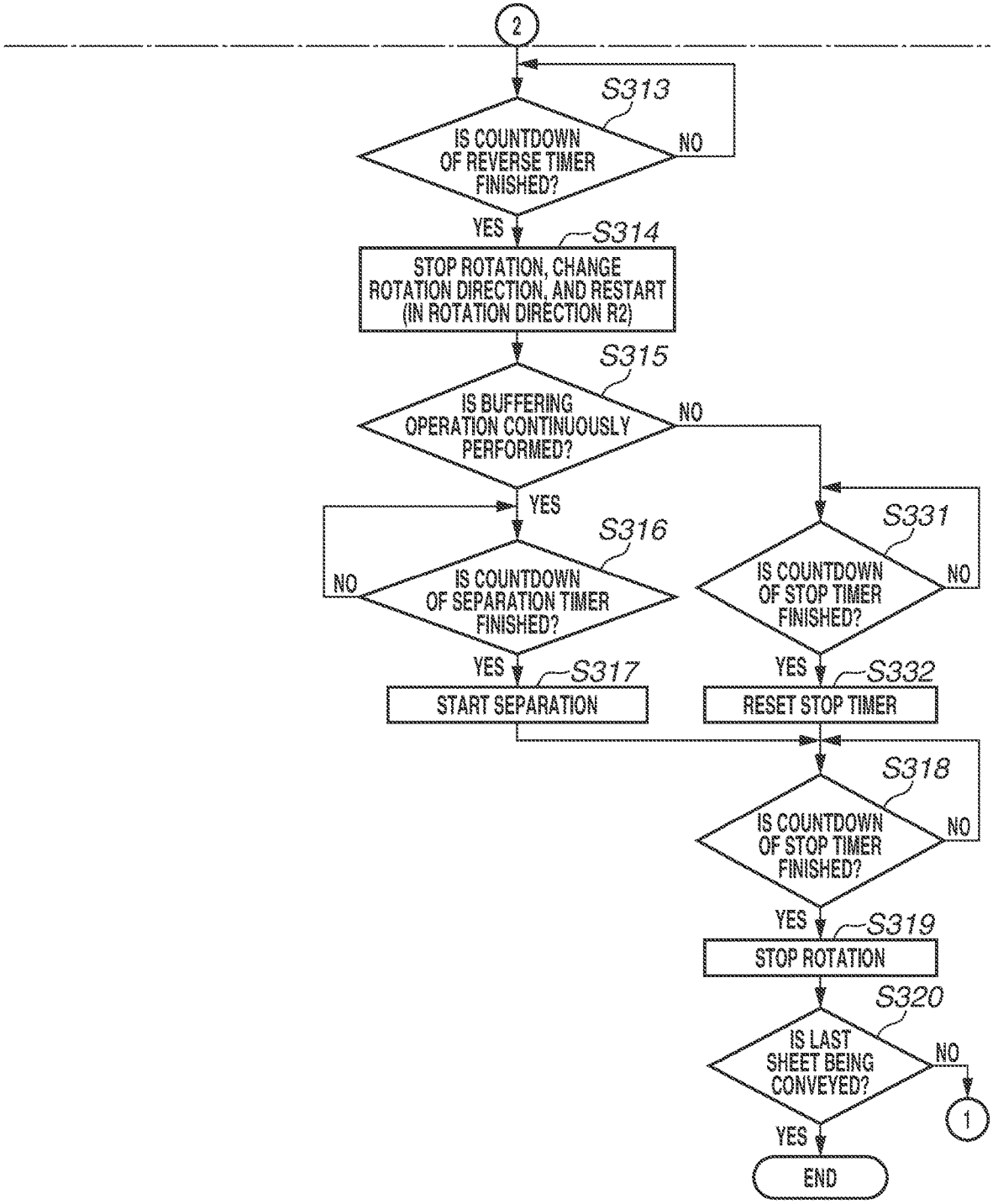

Next, an operation sequence of the reverse rollers 24 will be described with reference to FIGS. 8A and 8B.

In step S301, it is determined whether the sheet being conveyed is the buffering operation target. If the sheet being conveyed is the buffering operation target (YES in step S301), the processing proceeds to step S302. If the sheet being conveyed is not the buffering operation target (NO in step S301), the processing proceeds to step S321. The sheet determined to be the buffering operation target refers to a sheet in the subsequent sheet bundle delivered from the image forming apparatus 1 to the post-processing apparatus 4 before binding processing on the preceding sheet bundle is finished in a case where an image forming job to form a plurality of sheet bundles is executed in the binding processing portion 4A. The number of sheets subjected to the buffering operation is determined in advance depending on the content (particularly, intervals at which sheets are discharged from the image forming apparatus 1, and the length and process speed of each sheet in the conveyance direction) of the image forming job received from the printer control unit 1000.

Steps S302 to S320 indicate the content of operation on the sheet determined to be the buffering operation target. In step S302, it is determined whether the first sheet is being conveyed. If the first sheet is being conveyed (YES in step S302), the processing proceeds to step S303. If the first sheet is not being conveyed (NO in step S302), the processing proceeds to step S307.

In step S303, the rotation of the reverse rollers 24 is started at the target speed V1 in the rotation direction R1 corresponding to the conveyance direction before the reverse operation, and the reverse rollers 24 are brought into the contact state to form the nip portion. In step S304, it is determined whether the passage of the sheet trailing edge on the receiving path 81 is detected by the inlet sensor 27 in the standby state. If the passage of the sheet trailing edge is detected by the inlet sensor 27 (YES in step S304), the processing proceeds to step S305. In step S305, processing of accelerating the reverse rollers 24 to the target speed V2 is started. In step S306, various timers are set. An end time of a reverse timer is set to a timing that is after the second edge of the sheet passes through the non-return valve 23 and before the second edge of the sheet passes through the reverse rollers 24. An end time of a separation timer is set to a timing after the leading edge (second edge) of the sheet reversed by the reverse rollers 24 reaches the internal discharge rollers 26. An end time of the stop timer is set to be synchronized with the stop of the rotation of the internal discharge rollers 26 (step S408 in FIG. 9).

Processing after step S306 is similar to processing to be executed if it is determined that the first sheet is not being conveyed (NO in step S302), and then the processing proceeds to step S313.

In step S307, it is determined whether the passage of the sheet trailing edge on the receiving path 81 is detected by the inlet sensor 27 in the standby state. If the passage of the sheet trailing edge is detected by the inlet sensor 27 (YES in step S307), the processing proceeds to step S308. In step S308, various timers are set. An end time of the start timer is set to be synchronized with the start of the operation of reverse feed of the sheet by the internal discharge rollers 26 (step S411 in FIG. 9). An end time of a nip timer is set to a timing after the peripheral speed of the reverse rollers 24 that have started to rotate in step S310 as described below reaches the speed V2. An end time of the reverse timer is set to a timing that is after the sheet trailing edge on the receiving path 81 passes through the non-return valve 23 and before the sheet trailing edge passes through the reverse rollers 24. An end time of the separation timer is set to a timing after the leading edge (second edge) of the sheet reversed by the reverse rollers 24 reaches the internal discharge rollers 26. An end time of the stop timer is set to be synchronized with the stop of the rotation of the internal discharge rollers 26 (step S419 in FIG. 9).

In step S309, countdown of the start timer is performed in the standby state. At this time, the sheet being conveyed reaches the reverse rollers 24 while the reverse rollers 24 stand by in the separated state, and the sheet is superimposed on the sheet nipped by the internal discharge rollers 26 (FIG. 3D). If the countdown is finished (YES in step S309), the processing proceeds to step S310. In step S310, the rotation of the reverse rollers 24 is started at the target speed V1 in the rotation direction R1 corresponding to the conveyance direction before the reverse operation. In step S311, countdown of the nip timer is performed in the standby state. If the countdown is finished (YES in step S311), the processing proceeds to step S312. In step S312, the supply of power to the plunger solenoid 45 is stopped to bring the reverse rollers 24 into the contact state (FIG. 4A). At this time, the state of the reverse rollers 24 is changed from the separated state to the contact state in a state where the reverse rollers 24 are rotated at the peripheral speed equal to that of the internal discharge rollers 26. Processing after step S312 is similar to processing to be executed if it is determined that the first sheet is being conveyed (YES in step S302), and then the processing proceeds to step S313.

In step S313, countdown of the reverse timer is performed in the standby state. If the countdown is finished (YES in step S313), the processing proceeds to step S314. In step S314, the rotation of the reverse rollers 24 is temporarily stopped (FIG. 4B) and the rotation direction is changed from the rotation direction R1 corresponding to the conveyance direction before the reverse operation to the rotation direction R2 corresponding to the conveyance direction after the reverse operation, and then the rotation of the reverse rollers 24 is restarted at the target speed V2.

In step S315, it is determined whether the buffering operation is continuously performed (whether the sheet to be subsequently conveyed is the buffering operation target). If the buffering operation is continuously performed (YES in step S315), the processing proceeds to step S316. In step S316, countdown of the separation timer is performed in the standby state. If the countdown is finished (YES in step S316), the processing proceeds to step S317. In step S317, the supply of power to the plunger solenoid 45 is stopped to bring the reverse rollers 24 into the separated state (FIG. 4C). In step S318, countdown of the stop timer is performed in the standby state. If the countdown is finished (YES in step S318), the processing proceeds to step S319. In step S319, the rotation of the reverse rollers 24 is stopped. In step S320, it is determined whether the last sheet is being conveyed. If the last sheet is not being conveyed (NO in step S320), the processing returns to step S301 to continue the processing. If the last sheet is being conveyed (YES in step S320), the operation sequence is terminated. On the other hand, if it is determined that the buffering operation is not continuously performed (NO in step S315), the processing proceeds to step S331. In step S331, it is determined whether countdown of the stop timer is finished. If the countdown of the stop timer is finished (YES in step S331), the processing proceeds to step S332. In step S332, the stop timer is reset. An end time of the reset stop timer is set to a timing after the sheet trailing edge on the internal discharge path 82 has passed through the reverse rollers 24. After step S332, the processing proceeds to step S318 to execute the above-described processing.

Steps S321 to S329 indicate operations to be performed on each sheet other than the sheet subjected to the buffering operation. In this case, the sheet is reversely conveyed by the reverse rollers 24 while the reverse rollers 24 are in the contact state. Specifically, in step S321, the rotation of the reverse rollers 24 is started at the target speed V1 in the rotation direction R1 corresponding to the conveyance direction before the reverse operation and the reverse rollers 24 are brought into the contact state to form the nip portion. In step S322, it is determined whether the passage of the sheet trailing edge on the receiving path 81 is detected by the inlet sensor 27 in the standby state. If the passage of the sheet trailing edge is detected by the inlet sensor 27 (YES in step S322), the processing proceeds to step S323. In step S323, processing of accelerating the reverse rollers 24 to the target speed V2 is started. In step S324, various timers are set. An end time of the reverse timer is set to a timing that is after the second edge of the sheet passes through the non-return valve 23 and before the second edge of the sheet passes through the reverse rollers 24. An end time of the stop timer is set to a timing after the sheet trailing edge on the internal discharge path 82 passes through the reverse rollers 24.

In step S325, countdown of the reverse timer is performed in the standby state. If the countdown is finished (YES in step S325), the processing proceeds to step S326. In step S326, the rotation of the reverse rollers 24 is temporarily stopped and the rotation direction is changed from the rotation direction R1 corresponding to the conveyance direction before the reverse operation to the rotation direction R2 corresponding to the conveyance direction after the reverse operation, and then the rotation of the reverse rollers 24 is restarted at the target speed V2. In step S327, countdown of the stop timer is performed in the standby state. If the countdown is finished (YES in step S327), the processing proceeds to step S328. In step S328, the rotation of the reverse rollers 24 is stopped. In step S329, it is determined whether the last sheet is being conveyed. If the last sheet is not being conveyed (NO in step S329), the processing returns to step S301 to continue the processing. If the last sheet is being conveyed (YES in step S329), the operation sequence is terminated.

Operation Sequence of Internal Discharge Rollers

Figure 9:
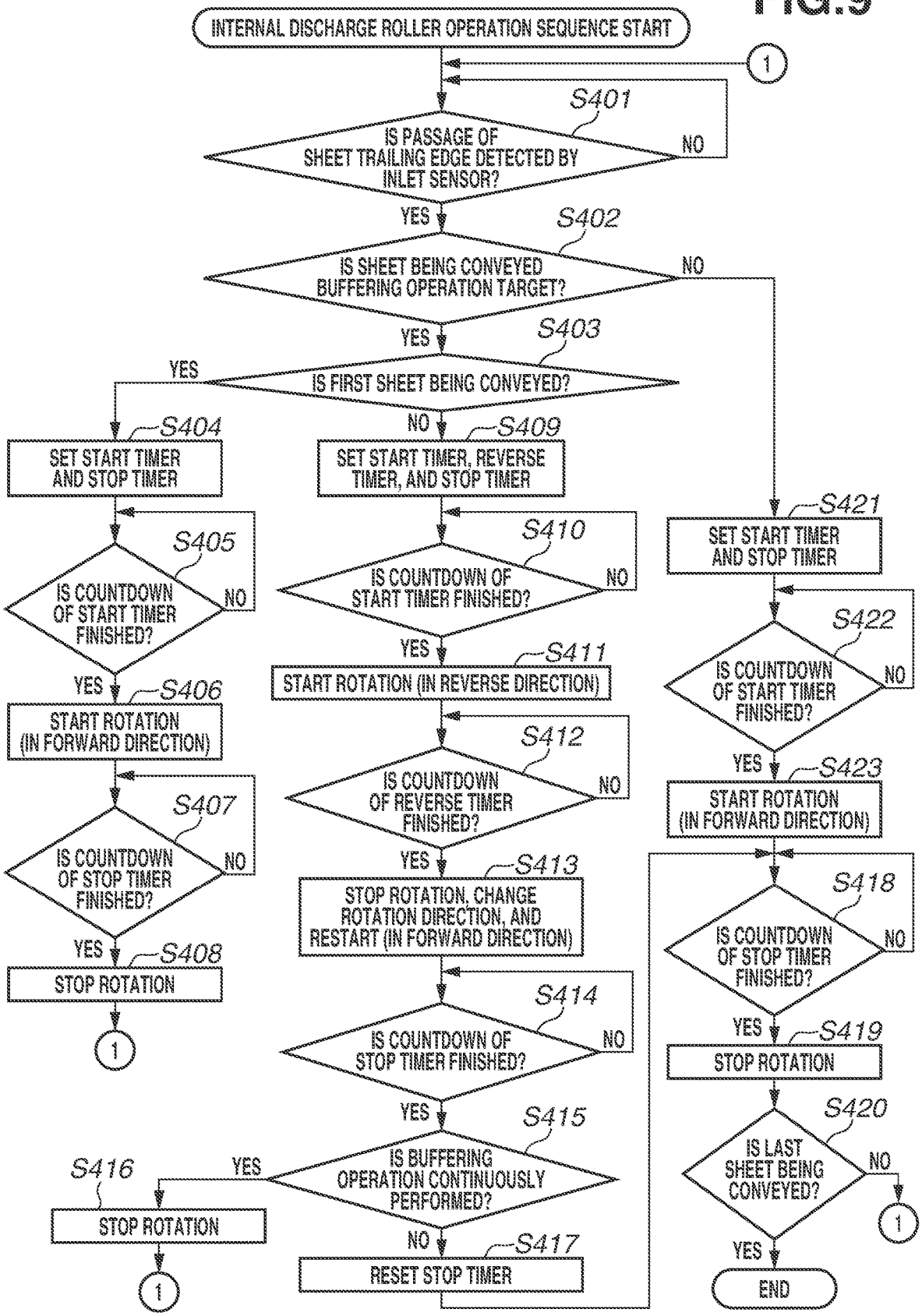
FIG. 9 is a flowchart illustrating an internal discharge roller operation sequence according to the first exemplary embodiment.

Next, an operation sequence of the internal discharge rollers 26 will be described with reference to FIG. 9.

In step S401, it is determined whether the passage of the sheet trailing edge on the receiving path 81 is detected by the inlet sensor 27 in the standby state. If the passage of the sheet trailing edge is detected by the inlet sensor 27 (YES in step S401), the processing proceeds to step S402. In step S402, it is determined whether the sheet being conveyed is the buffering operation target. If the sheet being conveyed is the buffering operation target (YES in step S402), the processing proceeds to step S403. If the sheet being conveyed is not the buffering operation target (NO in step S402), the processing proceeds to step S421. In step S403, it is determined whether the sheet being conveyed is the first sheet in the sheet bundle to be processed in the binding processing portion 4A. If the sheet being conveyed is the first sheet (YES in step S403), the processing proceeds to step S404. If the sheet being conveyed is not the first sheet (NO in step S403), the processing proceeds to step S409.

In step S404, various timers are set based on the timing when the passage of the sheet trailing edge is detected by the inlet sensor 27 in step S401. An end time of the start timer is set to a timing when the conveyance speed of the internal discharge rollers 26 is accelerated to the target speed V2 before the sheet reversed by the reverse rollers 24 reaches the internal discharge rollers 26. An end time of the stop timer is set to a timing when the sheet leading edge on the internal discharge path 82 passes through the reverse rollers 24 and is conveyed by a predetermined distance.

In step S405, countdown of the start timer is performed in the standby state. If the countdown is finished (YES in step S405), the processing proceeds to step S406. In step S406, the rotation of the internal discharge rollers 26 is started at the target speed V2 in the rotation direction R3 along the forward direction on the internal discharge path 82. In step S407, countdown of the stop timer is performed in the standby state. If the countdown is finished (YES in step S407), the processing proceeds to step S408. In step S408, the rotation of the internal discharge rollers 26 is stopped, and then the processing returns to step S401. In step S408, the timing of stopping the rotation of the internal discharge rollers 26 is synchronized with the timing of stopping the rotation of the reverse rollers 24 in step S319 illustrated in FIG. 8. The rotation of the internal discharge rollers 26 is stopped in step S408, thereby allowing the first sheet determined to be the buffering operation target to stop in a state where the first sheet is held by the internal discharge rollers 26 (FIG. 3D).

Steps S409 to S418 indicate the content of operation to be performed when each sheet (other than the first sheet) determined to be the buffering operation target is conveyed. In this case, however, not the sheet being conveyed, but the sheet (sheet subjected to the buffering operation) held by the internal discharge rollers 26 is brought into contact with the internal discharge rollers 26 during execution of steps S409 to S413. For example, when the internal discharge rollers 26 perform the operation on the second sheet S2 as the "sheet being conveyed" in FIGS. 3D to 4C, the internal discharge rollers 26 actually cause the first sheet S1 subjected to the buffering operation to move until the second edge S2*b* of the sheet S2 reaches the internal discharge rollers 26 between the state illustrated in FIG. 4B and the state illustrated in FIG. 4C.

In step S409, various timers are set based on the timing when the passage of the sheet trailing edge is detected by the inlet sensor 27 in step S401. An end time of the start timer is set such that the shift amount between the sheet that is started to be conveyed in the reverse direction in step S411 as described below and is subjected to the buffering operation and the sheet being conveyed is set to the predetermined shift amount k. An end time of the reverse timer is set to be synchronized with the timing of starting the rotation of the reverse rollers 24 in the rotation direction R2 corresponding to the conveyance direction after the reverse operation (step S314 in FIG. 8). An end time of the stop timer is set to a timing when the second edge of the sheet being conveyed (the second edge of the uppermost sheet when a plurality of sheets is held by the internal discharge rollers 26 and is subjected to the buffering operation) passes through the internal discharge rollers 26 and is conveyed by a predetermined distance.

In step S410, countdown of the start timer is performed in the standby state. If the countdown is finished (YES in step S410), the processing proceeds to step S411. In step S411, the rotation of the internal discharge rollers 26 is started at the target speed V2 in the rotation direction R4 along the reverse direction on the internal discharge path 82. As a result, the sheet subjected to the buffering operation is conveyed in the reverse direction, and the conveyed sheet and the sheet that is being conveyed and delivered in from the pre-buffer rollers 22 are superimposed by the predetermined shift amount k (FIGS. 4A and 4B). The conveyance speed (V2) at which the internal discharge rollers 26 convey the sheet in the reverse direction is equal to the conveyance speed at which the pre-buffer rollers 22 deliver the sheet into the reverse rollers 24.

In step S412, countdown of the reverse timer is performed in the standby state. If the countdown is finished (YES in step S412), the processing proceeds to step S413. In step S413, the rotation of the internal discharge rollers 26 is temporarily stopped and the rotation direction of the internal discharge rollers 26 is changed from the reverse direction to the forward direction (rotation direction R4 to rotation direction R3), and then the rotation of the internal discharge rollers 26 is restarted at the target speed V2. This reverse operation by the internal discharge rollers 26 is performed in synchronization with the reverse operation (step S314 in FIG. 8) of the reverse rollers 24. Thus, the sheet being conveyed and the sheet subjected to the buffering operation are delivered in the superimposed state to the internal discharge rollers 26 from the reverse rollers 24 (FIG. 4C).

In step S414, countdown of the stop timer is performed in the standby state. If the countdown is finished (YES in step S414), the processing proceeds to step S415. In step S415, it is determined whether the buffering operation is continuously performed (whether the sheet that subsequently reaches the internal discharge rollers 26 is also the buffering operation target). If the buffering operation is continuously performed (YES in step S415), the processing proceeds to step S416. In step S416, the rotation of the internal discharge rollers 26 is stopped based on the end time of the stop timer. Then, the processing returns to step S401 to continue the processing. In this case, the processing of steps S409 to S414 is repeatedly performed on the subsequent sheet, so that three or more sheets are superimposed at the buffer portion. If the buffering operation is not continuously performed (NO in step S415), the processing proceeds to step S417. In step S417, the stop timer is reset and the rotation of the internal discharge rollers 26 is continued. An end time of the reset stop timer is set to a timing after the trailing edge of the sheet (the first edge of the sheet being conveyed) on the internal discharge path 82 has passed through the internal discharge rollers 26. In step S418, countdown of the stop timer is performed in the standby state. If the countdown is finished (YES in step S418), the processing proceeds to step S419. In step S419, the rotation of the internal discharge rollers 26 is stopped. In step S420, it is determined whether the last sheet is being conveyed. If the last sheet is not being conveyed (NO in step S420), the processing returns to step S401 to continue the processing. If the last sheet is being conveyed (YES in step S420), the operation sequence is terminated.

Steps S421 to S423 indicate operations to be performed on each sheet other than the sheet subjected to the buffering operation. In this case, the internal discharge rollers 26 simply convey the sheet received from the reverse rollers 24 in the forward direction toward the binding processing portion 4A, without conveying the sheet in the reverse direction. Specifically, in step S421, various timers are set based on the timing when the passage of the sheet trailing edge is detected by the inlet sensor 27 in step S401. An end time of the start timer is set to a timing when the internal discharge rollers 26 can be accelerated to the target speed V2 before the sheet reversed by the reverse rollers 24 reaches the internal discharge rollers 26. An end time of the stop timer is set to a timing after the sheet trailing edge on the internal discharge path 82 passes through the internal discharge rollers 26.

In step S422, countdown of the start timer is performed in the standby state. If the countdown is finished (YES in step S422), the processing proceeds to step S423. In step S423, the rotation of the internal discharge rollers 26 is started at the target speed V2 in the rotation direction R3 along the forward direction on the internal discharge path 82. After that, in step S418, countdown of the stop timer is performed in the standby state. If the countdown is finished (YES in step S418), the processing proceeds to step S419. In step S419, the rotation of the internal discharge rollers 26 is stopped. In step S420, it is determined whether the last sheet is being conveyed. If the last sheet is not being conveyed (NO in step S420), the processing returns to step S401 to continue the processing. If the last sheet is being conveyed (YES in step S420), the operation sequence is terminated.

Next, a movable reverse upper guide 420 will be described with reference to FIGS. 10A to 20. As described above with reference to FIGS. 2 to 9, the non-return valve 23 is configured to be rotatably supported about the rotational shaft 23*a* with respect to the internal discharge upper guide 46. In configurations illustrated in FIGS. 10A to 20, the movable reverse upper guide 420 is used in place of the non-return valve 23. In the description with reference to FIGS. 10A to 20, descriptions of components similar to those in FIGS. 1 to 9 are omitted.

Figure 10A:
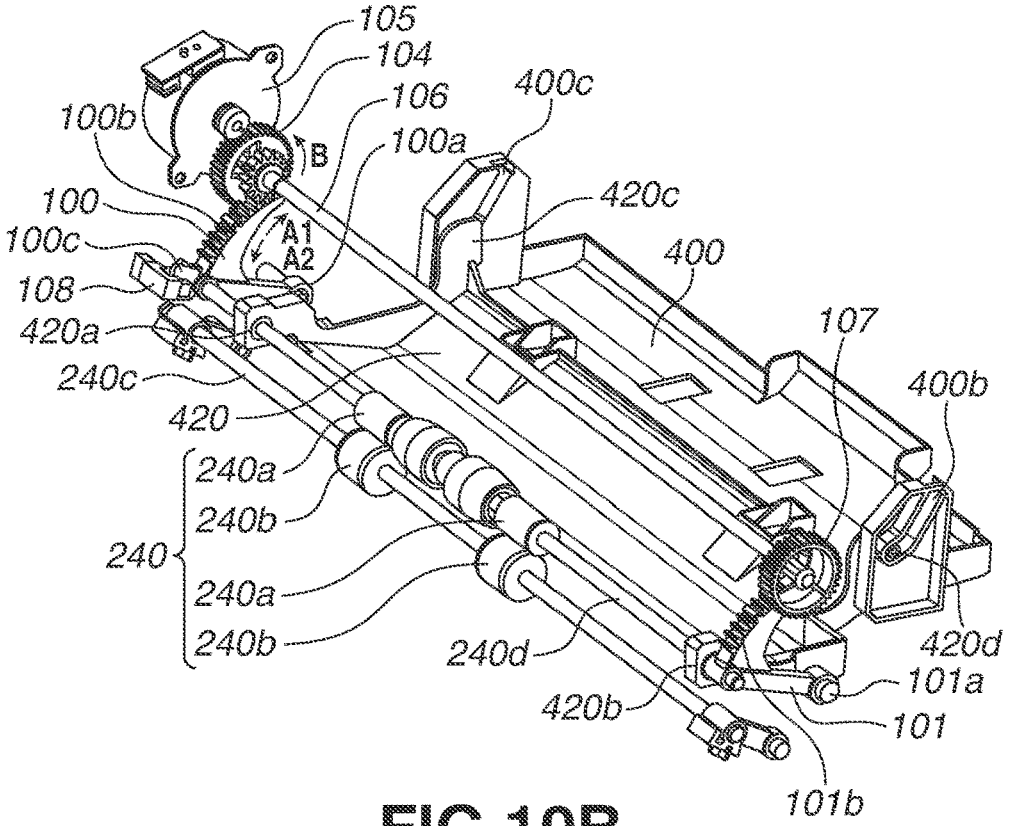
FIG. 10A is a perspective view illustrating a movable guide member according to the first exemplary embodiment.
Figure 10B:
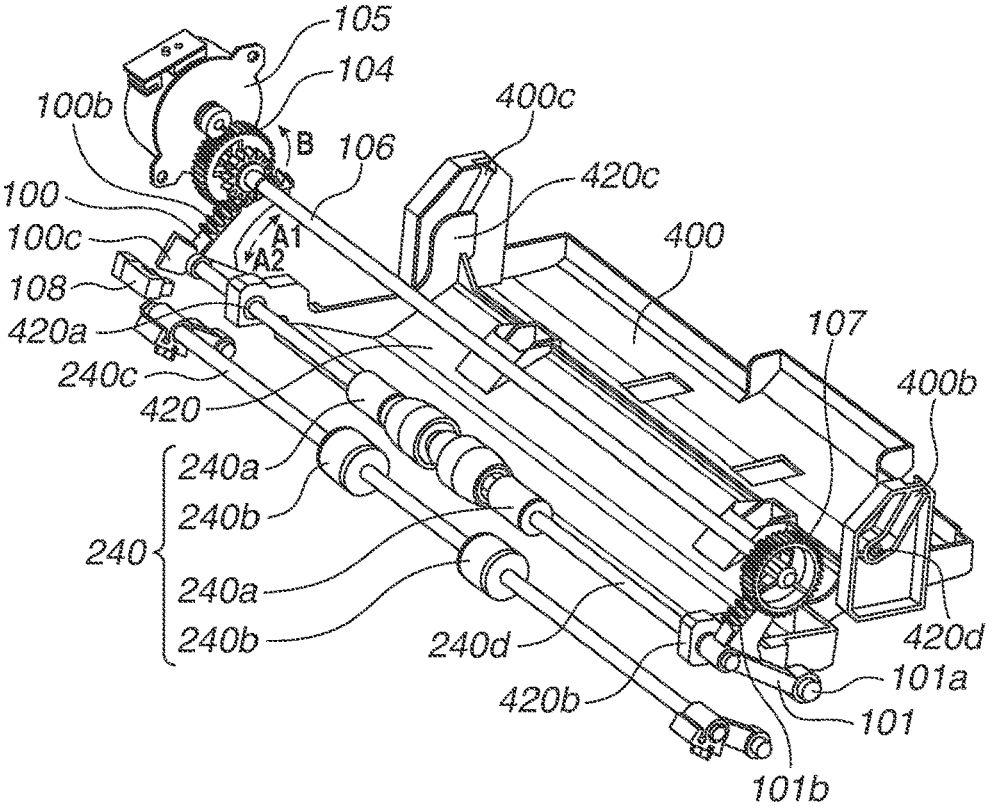
FIG. 10B is a perspective view illustrating the movable guide member according to the first exemplary embodiment.

FIGS. 10A, 10B and 12A each illustrate the configuration in which the movable reverse upper guide 420 is adopted in the configuration illustrated in FIG. 2. An inlet upper guide 400 is provided as a fixing guide corresponding to the inlet upper guide 40 illustrated in FIG. 2. At the downstream side of the inlet rollers 21 and the inlet sensor 27, the inlet upper guide 400 and an inlet lower guide 410 functioning as a third conveyance guide form a receiving path 810 functioning as a first conveyance path. The inlet upper guide 400 rotatably supports pre-buffer rollers 220 corresponding to the pre-buffer rollers 22. The inlet upper guide 400 includes a pre-buffer sensor 120 located at the upstream side of the pre-buffer rollers 220. The inlet upper guide 400 also includes rail grooves 400*c* and 400*b* functioning as a guide portion, and functions as a holding unit that movably holds the movable reverse upper guide 420 (first conveyance guide).

The reverse upper guide 420 supports reverse upper rollers 240*a* each functioning as a first reverse roller at a downstream end in the conveyance direction of the pre-buffer rollers 220 functioning as a first conveyance unit.

As illustrated in FIG. 10A, the inlet upper guide 400 includes rail grooves (400*c* and 400*b*) at both ends thereof in the axial direction of the reverse upper rollers 240*a*. The reverse upper guide 420 includes a guided portion 420*c* including a boss to be guided to the rail groove 400*c*, and a guided portion 420*d* including a boss to be guided to the rail groove 400*b*. The reverse upper guide 420 also includes a holding portion 420*a* that holds a reverse upper roller shaft 240*d* at one end of the reverse upper guide 420, and a holding portion 420*b* that holds the reverse upper roller shaft 240*d* at the other end of the reverse upper guide 420.

At one end in the axial direction of each reverse upper roller 240*a*, a separation lever 100 that rotatably supports the reverse upper roller shaft 420*d* that is the rotational shaft of the reverse upper roller 240*a* is provided. Similarly, a separation lever 101 is provided at the other end of the reverse upper roller 240*a*. A movement mechanism is composed of the separation lever 100 and the separation lever 101. The separation lever 100 is movable in the A1 and A2 directions in FIG. 1 about a support shaft 100*a* provided on a body frame (not illustrated). Similarly, the separation lever 101 is movable in the A1 and A2 directions in FIG. 1 about a support shaft 101*a* provided on the body frame (not illustrated). The separation lever 101 includes a gear train 101*b* functioning as a driven support gear, and the separation lever 100 includes a gear train 100*b* functioning as a driving support gear.

The gear train 100*b* of the separation lever 100 is driven by and coupled to a stepping motor 105 via a drive transmission gear 104. The drive transmission gear 104 transmits a driving force from the stepping motor 105 to a drive transmission gear 107 via a drive shaft 106. Accordingly, the separation lever 101 operates in synchronization with the separation lever 100 along with the rotation of the stepping motor 105. The above-described configuration enables the reverse upper rollers 240*a* and reverse lower rollers 240*b* each functioning as a second reverse roller to be brought into contact with each other or separated from each other. The reverse upper guide 420 is also configured to move in association with the separation and contact operation of the reverse upper rollers 240*a*. The reverse lower rollers 240*b* are supported by a lower roller shaft 240*c*.

FIG. 10A illustrates a state (first position) where the reverse upper rollers 240*a* and the reverse lower rollers 240*b* are in contact with each other and the reverse upper guide 420 is lowered. When the stepping motor 105 is driven, the drive transmission gear 104 is rotated in a B direction illustrated in FIGS. 10A and 10B, and the separation lever 100 is moved in the A1 direction illustrated in FIGS. 10A and 10B. As a result, the reverse rollers 240 are separated from each other as illustrated in FIG. 10B and the reverse upper guide 420 is moved to an upper position (second position). The separation lever 100 is provided with a light-shielding flag 100*c*, and shields or transmits infrared rays from a photosensor 108, thereby detecting the position of the separation lever 100.

Figure 11:
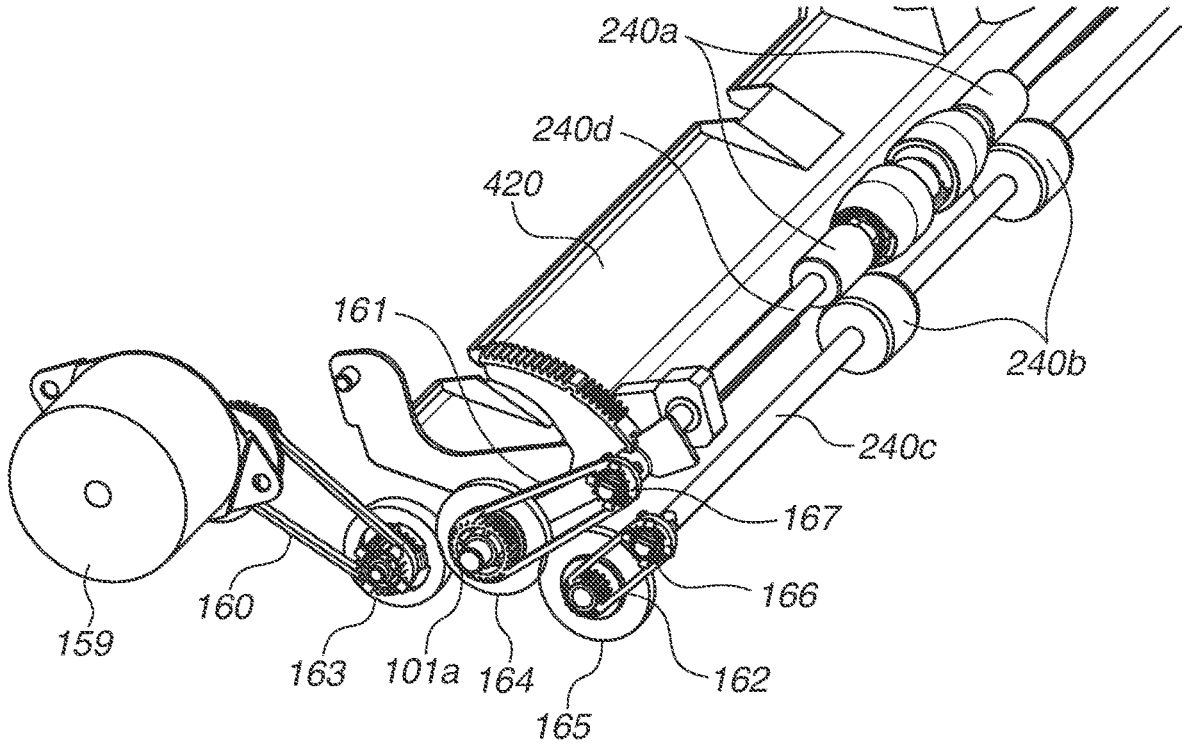
FIG. 11 is a perspective view of the guide member as viewed from one end thereof in FIG. 10A.

Next, transmission of a driving force to a reverse roller pair 240 functioning as a reverse unit will be described. FIG. 11 is a perspective view of the inlet upper guide 400 as viewed from one end in FIG. 10A. A reverse roller drive motor 159 is provided. Rotation belts 160, 161, and 162 are rotated by receiving the driving force from the reverse roller drive motor 159. Gear pulleys 163, 164, and 165 have a configuration in which a gear and a pulley are integrally formed.

The reverse upper roller shaft 240*d* includes a pulley 167 that engages with the reverse upper roller shaft 240*d* and rotates integrally with the reverse upper roller shaft 240*d*. The reverse lower roller shaft 240*c* includes a pulley 166 that engages with the reverse lower roller shaft 240*c* and rotates integrally with the reverse lower roller shaft 240*c*. The driving force from the reverse roller drive motor 159 is transmitted to the pulleys 166 and 167 via the rotation belts 160 to 162 and the gear pulleys 163 to 165.

The gear pulley 164 has a rotation center coaxial with the support shaft 101*a*, and thus the center distance of the rotation belt 161 is not changed even in a state where the reverse upper rollers 240*a* are in the separated state. As described above, the driving force is input to each of the reverse upper rollers 240*a* and the reverse lower rollers 240*b*, and the rotation of the reverse upper rollers 240*a* is constantly synchronized with the rotation of the reverse lower rollers 240*b*.

An operation to be performed during sheet supply will be described below.

Buffering Operation

Figure 12:
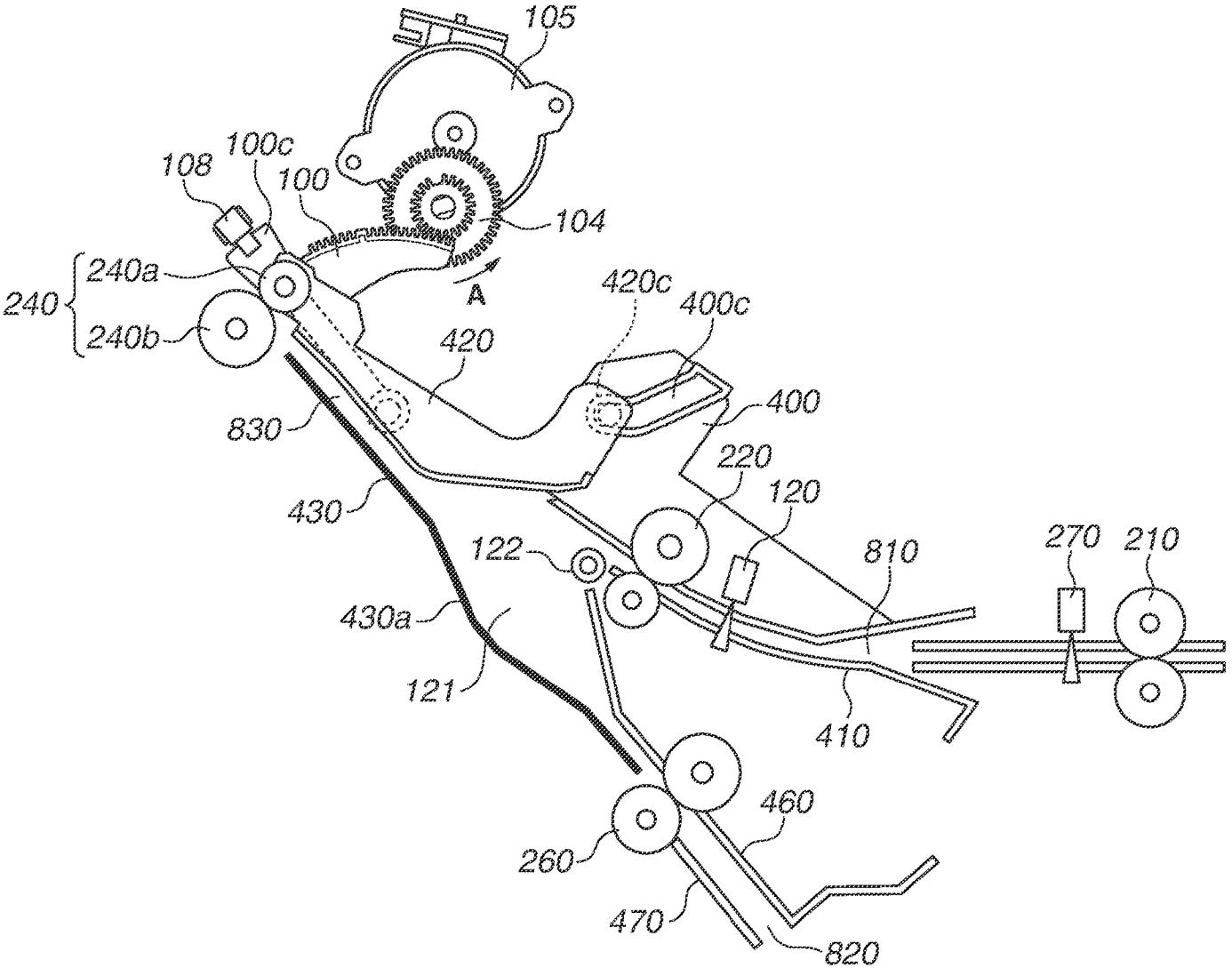
FIG. 12 is a sectional view illustrating the movable guide member according to the first exemplary embodiment.

Next, the buffering operation will be described in detail with reference to FIGS. 12 to 18B. As illustrated in FIG. 12, the "inlet upper guide 400" and the "inlet lower guide 410" form the sheet conveyance path (part of the receiving path 810) between the inlet rollers 210 and the pre-buffer rollers 220. Conveyance guides that form the sheet conveyance path (part of an internal discharge path 820) located downstream of internal discharge rollers 260 functioning as a conveyance roller pair are referred to as an "internal discharge upper guide 460" and an "internal discharge lower guide 470". The "reverse upper guide 420" is a conveyance guide that guides a sheet from the same side of the inlet upper guide 400 between the pre-buffer rollers 220 and the reverse rollers 240. A "reverse lower guide 430" is a second conveyance guide that guides a sheet from the same side of the internal discharge lower guide 470 between the reverse rollers 240 and the internal discharge rollers 260.

The sheet conveyed by the inlet rollers 210 is guided to the pre-buffer rollers 220 by the inlet upper guide 400 and the inlet lower guide 410. An inlet sensor 270 is located in the vicinity of the downstream side of the inlet rollers 210. As the inlet sensor 270, a reflection-type photosensor that radiates infrared light to a sheet and detects reflected light from the sheet to determine the presence or absence of the sheet at the detection position can be used. In this case, a hole having a size equal to or larger than the diameter of spot light of the inlet sensor 270 is formed in the inlet lower guide 410 at a portion opposing the inlet sensor 270 such that the infrared light is not reflected when the sheet is not passing through. The pre-buffer sensor 120 is a detection unit that determines the presence or absence of a sheet, like the inlet sensor 270, and detects the sheet remaining in the path due to a jam or the like.

FIG. 12 illustrates a state where the reverse roller 240*a* is in the contact state and the reverse upper guide 420 is located at the first position. The internal discharge path 820 (third conveyance path) is aligned with a first discharge path 830 (second conveyance path) via a merging portion, and the receiving path 810 (first conveyance path) is configured to merge with the merging portion obliquely toward the first discharge path.

Figure 13:
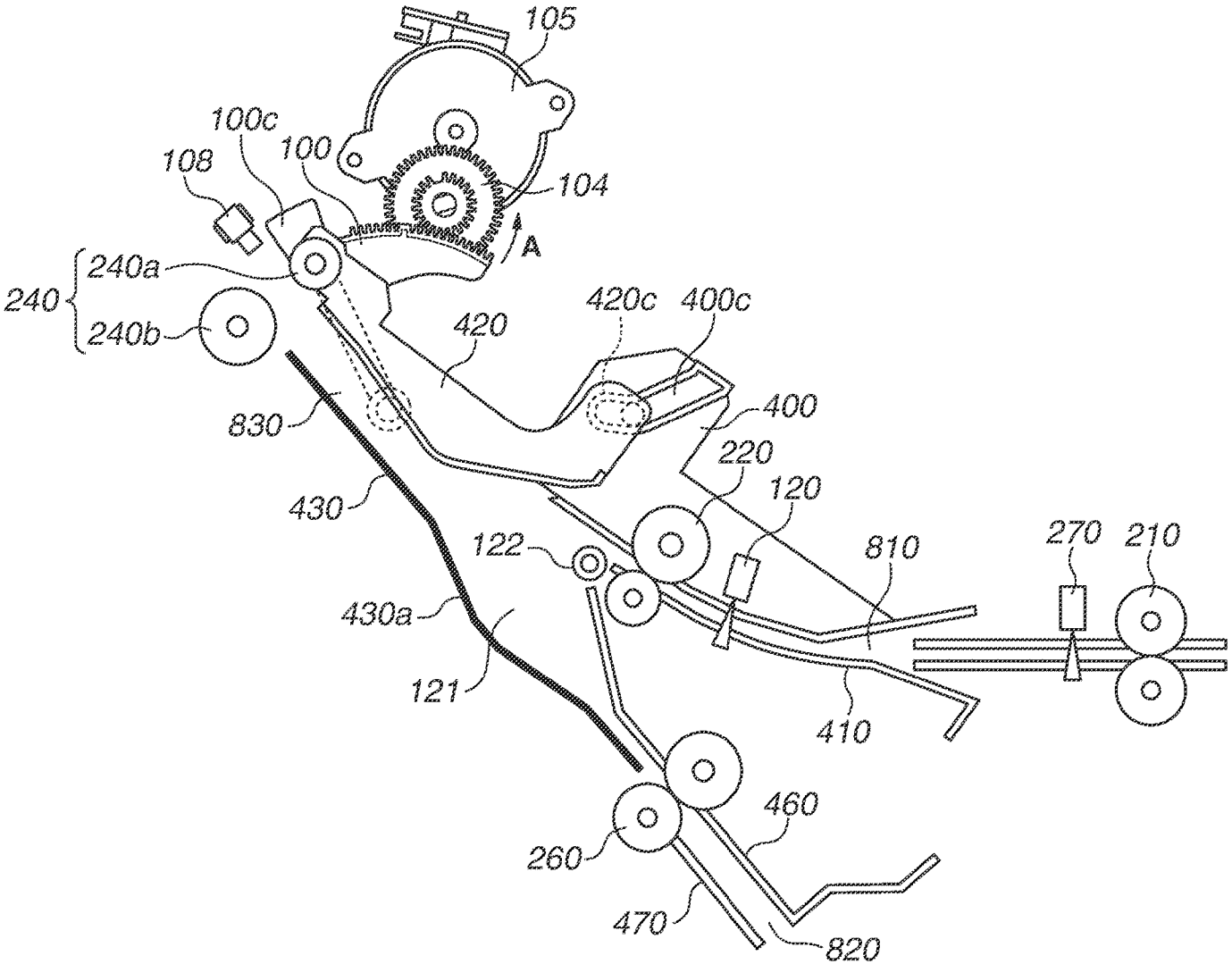
FIG. 13 is a sectional view illustrating the movable guide member according to the first exemplary embodiment.

FIG. 13 illustrates a state where the reverse rollers 240*a* are in the separated state and the reverse upper guide 420 is located at the second position. The separated state of the reverse upper roller 240*a* allows the reverse upper guide 420 to ascend. The reverse upper guide 420 then moves along the rail grooves 400*c* and 400*b* of the inlet upper guide 400 at the both ends, thereby moving from the first position to the second position, which leads to an increase in the width of the first discharge path 830. The increase in the width of the first discharge path 830 indicates an increase in the interval between the reverse lower guide 430 and the reverse upper guide 420. Specifically, the reverse upper guide 420 is configured to move between the first position and the second position. The first position is located at a first distance from the reverse lower guide 430. The second position is located at a second distance that is farther than the first distance.

When the sheet is conveyed from the receiving path 810 to the first discharge path 830, the angle of the sheet in the sheet conveyance direction is changed (FIG. 13), and when the sheet is conveyed from the first discharge path 830 to the internal discharge path 820, the sheet is linearly conveyed (FIG. 12).

Figure 14:
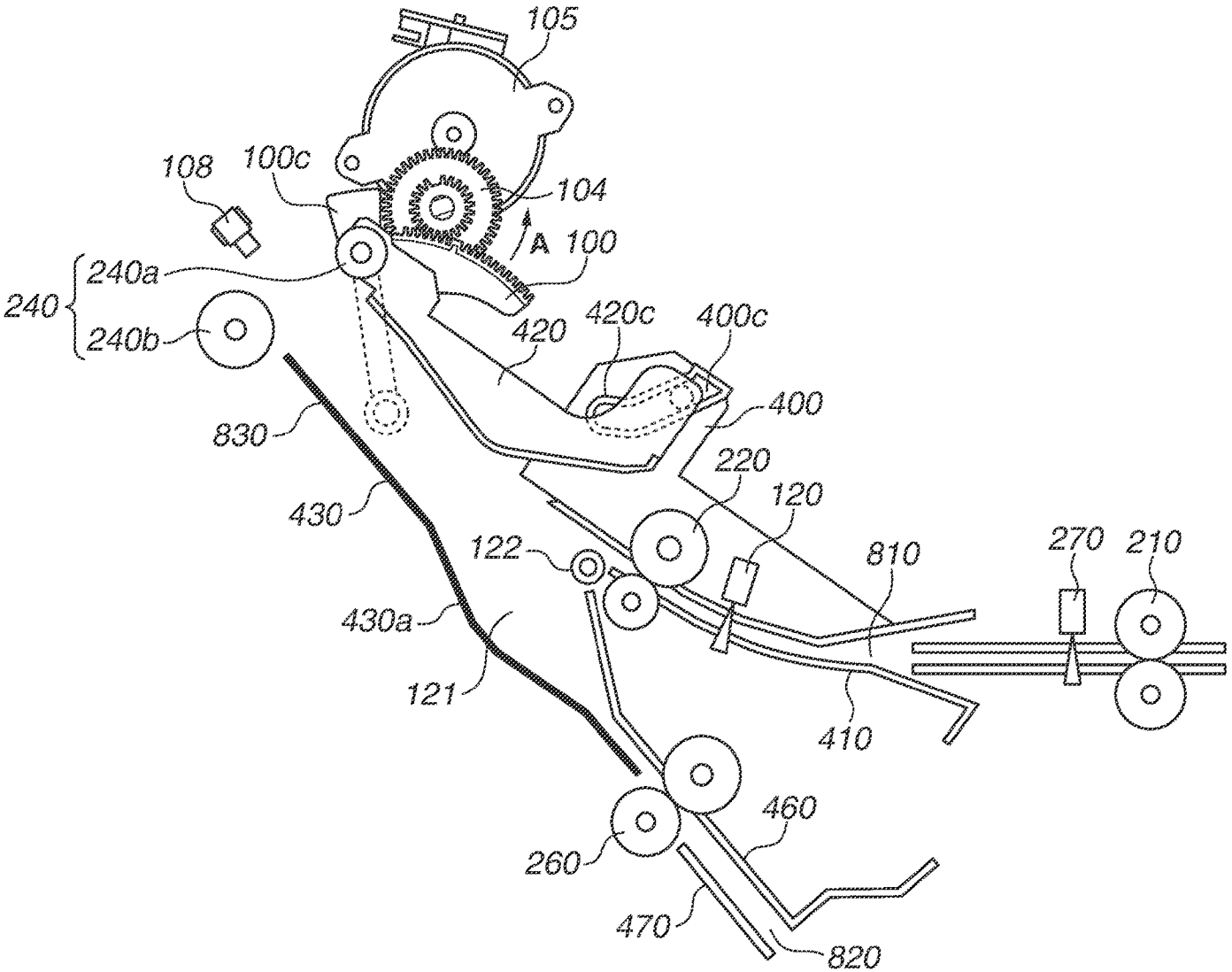
FIG. 14 is a sectional view illustrating the movable guide member according to the first exemplary embodiment.

FIG. 14 illustrates a state where the reverse upper guide 420 is raised to a position higher than the second position.

The reverse upper rollers 240*a* are further moved in the separating direction from the state illustrated in FIG. 13, thereby allowing the portion of the reverse upper guide 420 that is closer to the reverse rollers 240 to ascend and allowing the guided portion 420*c* of the reverse upper guide 420 to move the inlet upper guide 400*c*.

As a result, the reverse upper guide 420 moves substantially in parallel with the reverse lower guide 430, and is brought into the state illustrated in FIG. 14. If a jam occurs in the vicinity of the merging portion, the user accesses the merging portion from the side of the reverse rollers 240 in this state to remove the jammed sheet.

As illustrated in FIGS. 12 to 14, a reverse branch portion 121 between the receiving path 810 and the internal discharge path 820 is provided with reverse branch rollers 122 as a driven rotary member. When the sheet is conveyed from the receiving path 810 to the first discharge path 830 and the trailing edge of the sheet passes through the reverse branch rollers 122, the sheet is restored to a linear shape from a bent state. After that, the sheet can be reversed by the reverse rollers 240 and can be conveyed toward the internal discharge rollers 260 on the reverse lower guide 430.

The internal discharge rollers 260 are a roller pair that is adjacent to the reverse rollers 240 in the sheet conveyance direction on the internal discharge path 820 and is configured to rotate forward and backward. Specifically, the internal discharge rollers 260 can convey the sheet in the sheet conveyance direction (forward direction on the internal discharge path 820) from the reverse rollers 240 toward the binding processing portion 4A and in the reverse direction from the binding processing portion 4A toward the reverse rollers 240.

Next, the buffering operation in the buffer portion 4B will be described in detail with reference to FIGS. 15A to 18B. The buffering operation is an operation in which a predetermined number of sheets forming a subsequent sheet bundle are brought into a standby state in the buffer portion 4B until binding processing on a preceding sheet bundle is completed in the binding processing portion 4A. The buffering operation enables the image forming system 1S to execute image forming jobs including binding processing without lowering the productivity (the number of output images per unit time) of the image forming apparatus 1.

To distinguish the sheets from each other, the sheets are hereinafter referred to as the "sheet S1", the "sheet S2", and the "sheet S3". The sheet S1, the sheet S2, and the sheet S3 are sequentially delivered from the image forming apparatus 1 to the post-processing apparatus 4 in this order. One of the edges of each sheet that first passes through the inlet rollers 210 in the sheet conveyance direction is referred to as the "first edge", and the other edge of each sheet that subsequently passes through the inlet rollers 210 is referred to as the "second edge". The sheet conveyance speed in the horizontal conveyance portion 14 of the image forming apparatus 1 is represented by V1, and the sheet conveyance speed obtained after the conveyance speed is accelerated in the post-processing apparatus 4 is represented by V2.

Figure 15A:
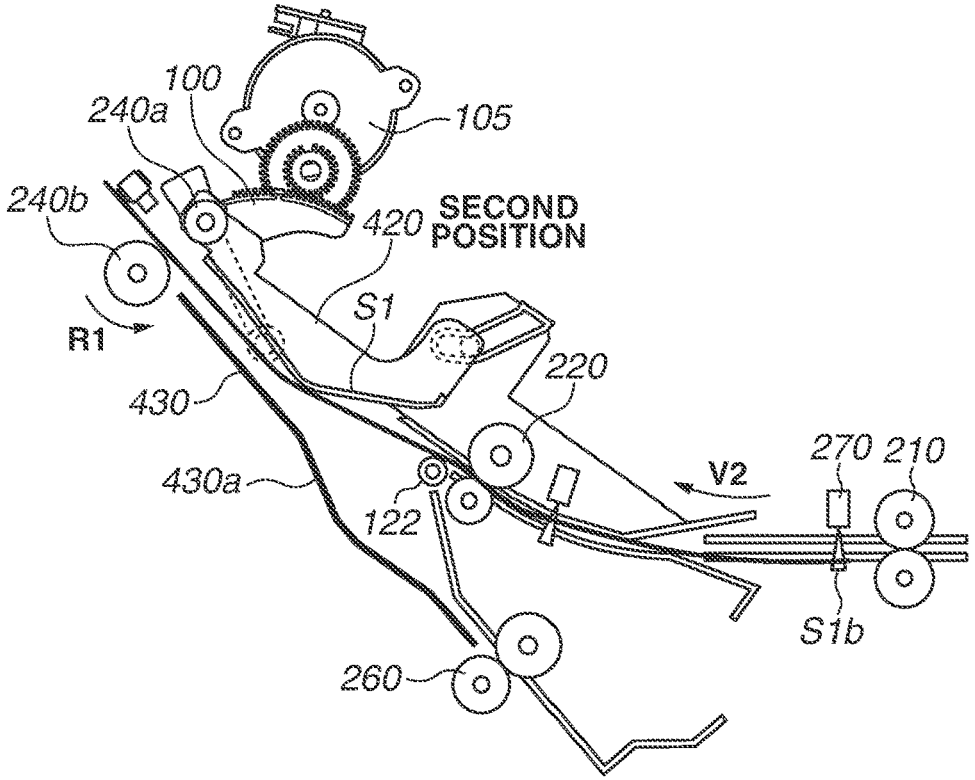
FIG. 15A is a sectional view illustrating the movable guide member according to the first exemplary embodiment.

FIG. 15A illustrates a state where the trailing edge (second edge S1*b*) of the sheet S1 on the receiving path 810 has passed through the detection position of the inlet sensor 270. When the passage of the second edge S1*b* of the sheet S1 is detected by the inlet sensor 270, the pre-buffer rollers 220 and the reverse rollers 240 accelerate the conveyance speed of the sheet S1 from the speed V1 to the speed V2. The acceleration of the conveyance speed of the sheet S1 increases the interval between the sheet S1 and the subsequent sheet S2 and secures the sheet interval adequate for the reverse operation (switchback) performed by the reverse rollers 240.

At the time point illustrated in FIG. 15A, the reverse upper guide 420 is located at the second position. The reverse upper guide 420 is moved to the first position before the first edge S1*a* of the sheet S1 passes through the reverse rollers 240 and the second edge S1*b* passes through the pre-buffer rollers 220. The operation timing is determined based on an elapsed time after the inlet sensor 270 detects the passage of the trailing edge (second edge S1*b*) of the sheet S1.

Figure 15B:
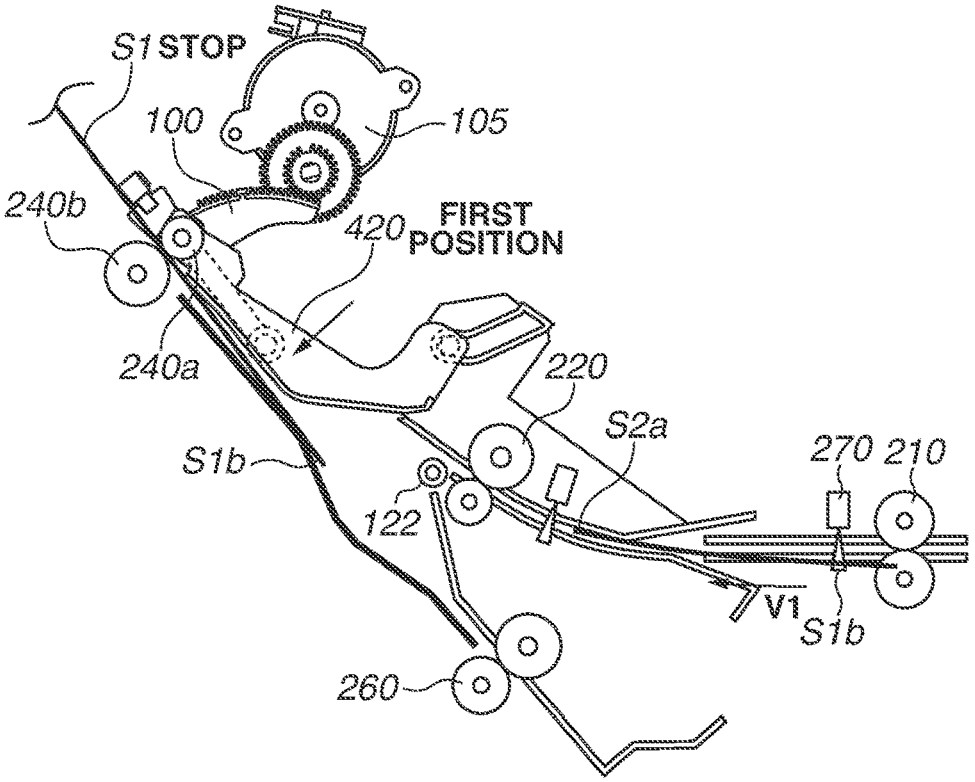
FIG. 15B is a sectional view illustrating the movable guide member according to the first exemplary embodiment.

FIG. 15B illustrates a state where the trailing edge (second edge S1*b*) of the sheet S1 on the receiving path 810 has passed through the reverse branch rollers 122. The rotation of the reverse rollers 240 is temporarily stopped at a predetermined timing after the trailing edge (second edge S1*b*) of the sheet S1 has passed through the reverse branch rollers 122. The predetermined timing is determined based on an elapsed time from the timing when the passage of the trailing edge (second edge S1*b*) of the sheet S1 is detected by the inlet sensor 270.

The rotation of the reverse rollers 240 in the rotation direction R2 corresponding to the rotation direction after the reverse operation is started from the state illustrated in FIG. 15B, and the trailing edge (second edge S1*b*) of the sheet S1 passes toward the internal discharge rollers 260 below the reverse branch rollers 122. At this time, the reverse upper guide 420 is located at the first position, and thus the first discharge path 830 is narrowed. This configuration regulates the orientation of the sheet and allows the sheet to be delivered to the internal discharge rollers 260 without moving backward to the receiving path 810. At this time, if the reverse upper guide 420 is located at the second position where the first discharge path 830 is widened, the orientation of the sheet is not regulated, so that the sheet can move backward to the receiving path 810 (first conveyance path).

Figure 16A:
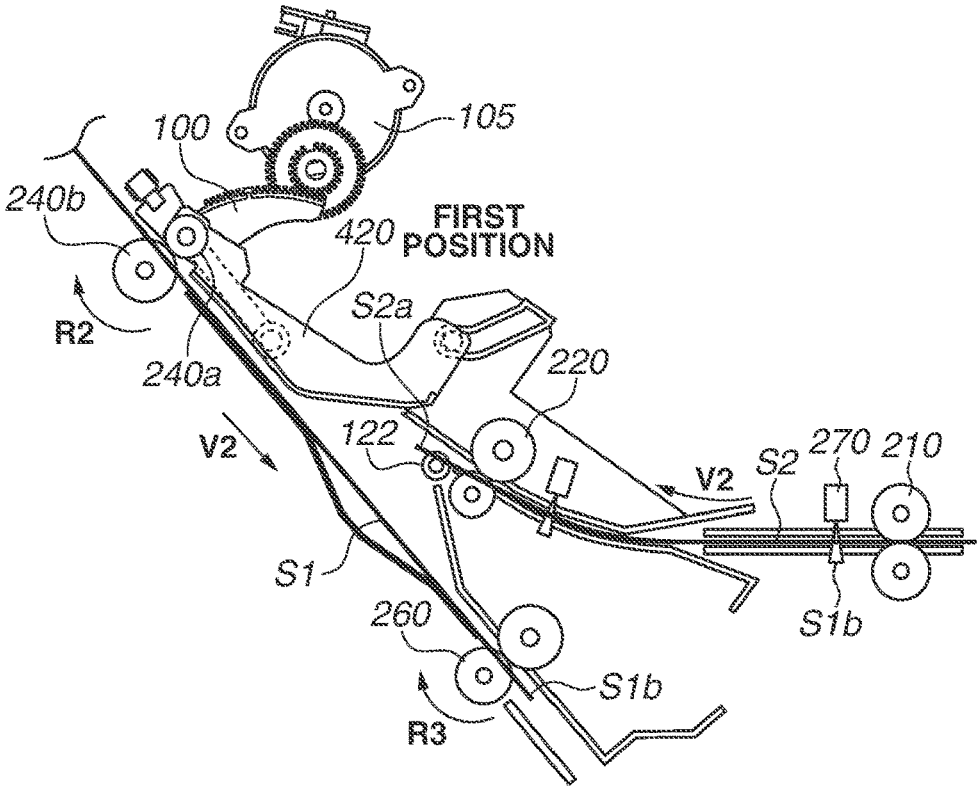
FIG. 16A is a sectional view illustrating the movable guide member according to the first exemplary embodiment.

FIG. 16A illustrates a state where the sheet S1 is delivered to the internal discharge rollers 260.

The internal discharge rollers 260 receive the sheet S1 in a state where the internal discharge rollers 260 are rotated in the rotation direction R3, and convey the sheet S1 in the forward direction on the internal discharge path 820. After the leading edge (second edge S1*b*) of the sheet S1 on the internal discharge path 820 has passed through the position of the reverse branch rollers 122, the leading edge (first edge S2*a*) of the sheet S2 on the receiving path 810 reaches the reverse branch rollers 122. Accordingly, the sheets S1 and S2 are conveyed such that the sheets S1 and S2 pass each other at the branch portion of the conveyance path.

Figure 16B:
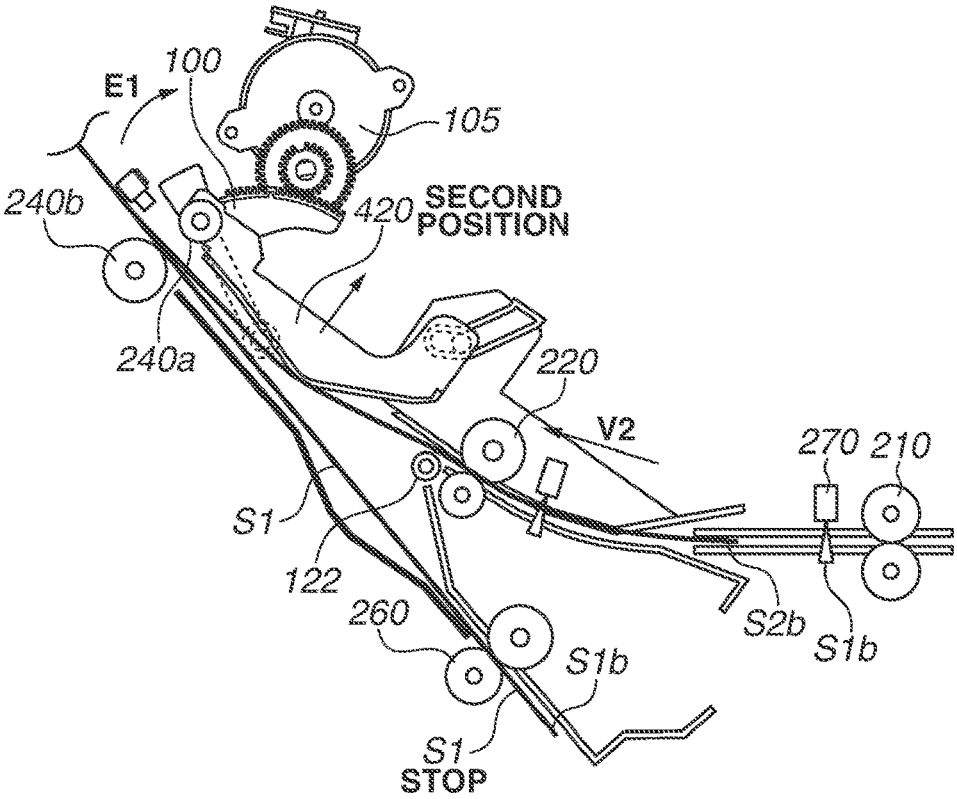
FIG. 16B is a sectional view illustrating the movable guide member according to the first exemplary embodiment.

FIG. 16B illustrates a state where the leading edge (second edge S1*b*) of the sheet S1 on the internal discharge path 820 is conveyed by a predetermined amount from the internal discharge rollers 260 and the rotation of the internal discharge rollers 260 is temporarily stopped. The stepping motor 105 is driven before the leading edge (first edge S2*a*) of the sheet S2 on the receiving path 810 reaches the reverse upper guide 420. As a result, the reverse upper rollers 240*a* are moved in the E1 direction and the reverse upper guide 420 is moved to the second position. The sheet S1 is held by the internal discharge rollers 260 that are stopped, and a part of the sheet S1 is located between the reverse rollers 240 in the separated state. Accordingly, the sheet S2 delivered in from the receiving path 810 by the pre-buffer rollers 220 is conveyed such that the sheet S2 slides on the sheet S1. At this time, if the width of the first discharge path 830 is narrow, the sliding resistance during sheet conveyance increases. This makes difficult to allow the leading edge of the sheet S2 to pass through the first discharge path 830, which may cause a jam. To avoid this, the reverse upper guide 420 is moved to the second position where the first discharge path 830 is wide, thereby allowing the sheet to be conveyed through the first discharge path 830 without causing a jam.

Figure 17A:
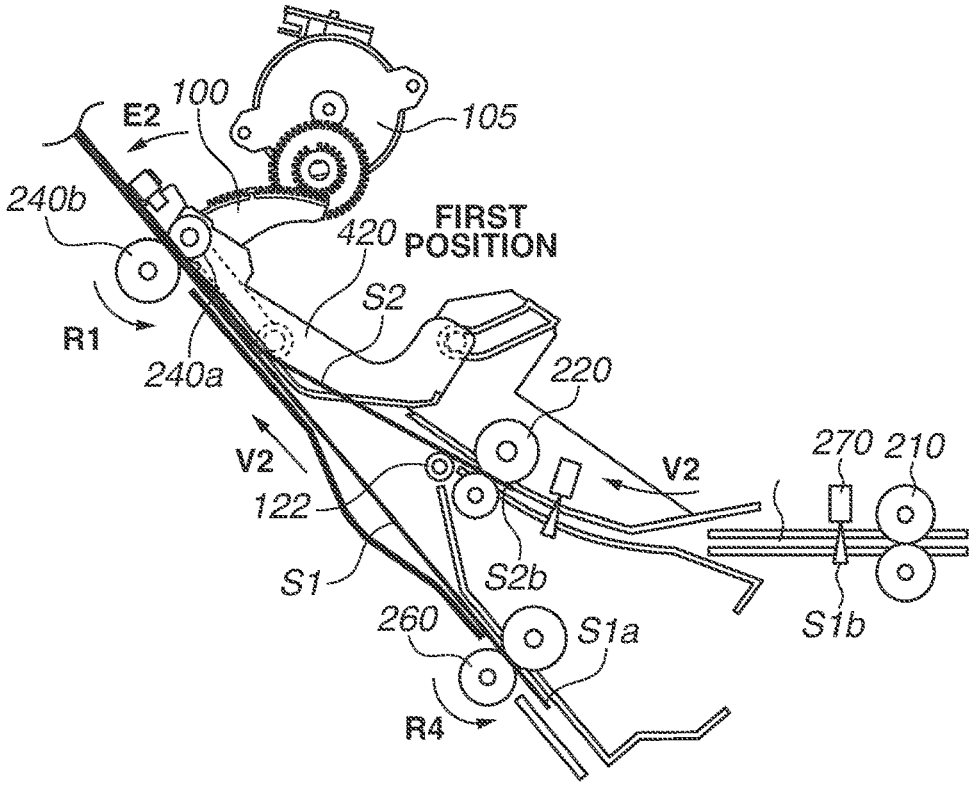
FIG. 17A is a sectional view illustrating the movable guide member according to the first exemplary embodiment.

FIG. 17A illustrates a state after the internal discharge rollers 260 start to convey the sheet S1 in the reverse direction. The rotation of the internal discharge rollers 260 in the rotation direction R4 is started at the timing when the sheet S2 is conveyed to the predetermined position, and the internal discharge rollers 260 convey the sheet S1 in the reverse direction toward the reverse rollers 240. The target speed of the internal discharge rollers 260 is set to the speed V2, like in the pre-buffer rollers 220. The stepping motor 105 is driven at a timing after the conveyance speed of the sheet S1 and the conveyance speed of the sheet S2 are substantially equal (relative speed is substantially zero). This enables the reverse upper rollers 240*a* to move in the E2 direction and brings the reverse rollers 240 into the contact state again, so that the sheets S1 and S2 are nipped in the superimposed state by the reverse rollers 240. The rotation of the reverse rollers 240 in the rotation direction R1 is started in synchronization with the internal discharge rollers 260, and the reverse rollers 240 are controlled to rotate at the peripheral speed (speed V2) equal to that of the pre-buffer rollers 220 and the internal discharge rollers 260 before the state of the reverse rollers 240 is changed from the separated state to the contact state.

Figure 17B:
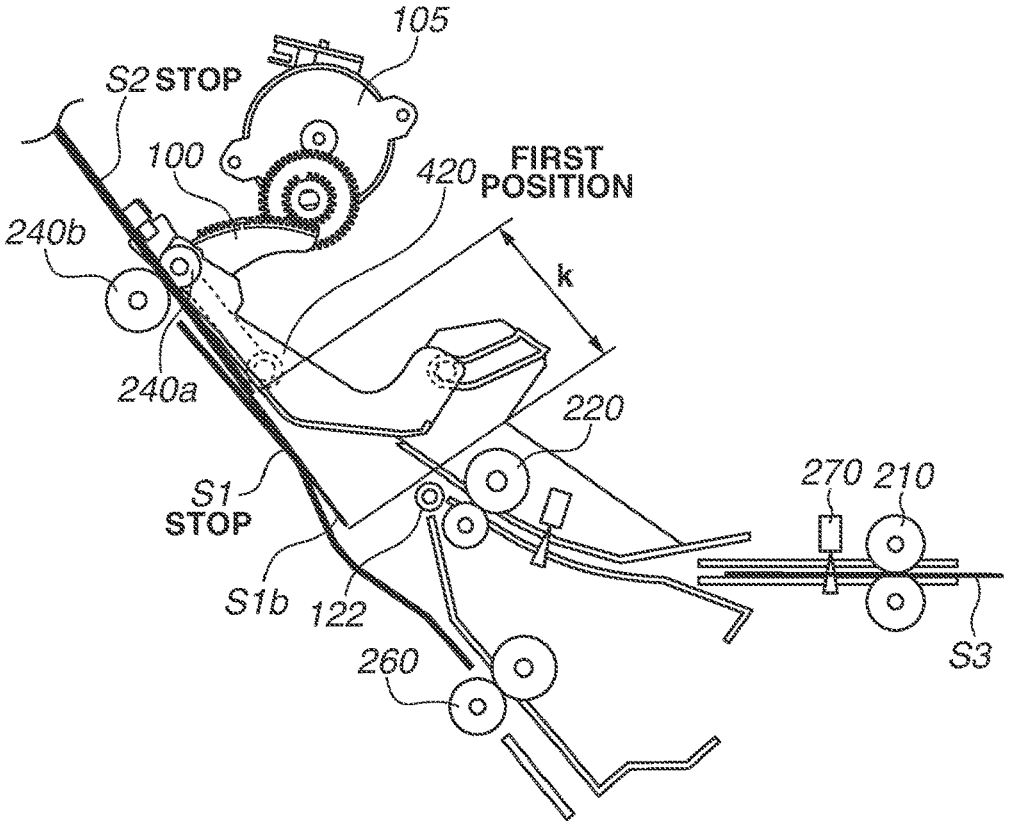
FIG. 17B is a sectional view illustrating the movable guide member according to the first exemplary embodiment.

FIG. 17B illustrates a state where the trailing edge (second edge S2*b*) of the sheet S2 on the receiving path 810 has passed through the reverse branch rollers 122. The rotation of the reverse rollers 240 is temporarily stopped at a predetermined timing after the trailing edge (second edge S2*b*) of the sheet S2 has passed through the reverse branch rollers 122. At this time, the movement of the superimposed sheets S1 and S2 is stopped, while the second edge S1*b* of the sheet S1 protrudes by the predetermined shift amount k in the forward direction of the internal discharge path 820 with respect to the second edge S2*b* of the sheet S2. The shift amount k is controlled based on the predetermined timing at which the internal discharge rollers 260 start to convey the sheet S1 in the reverse direction as described above with reference to FIG. 17A.

Figure 18A:
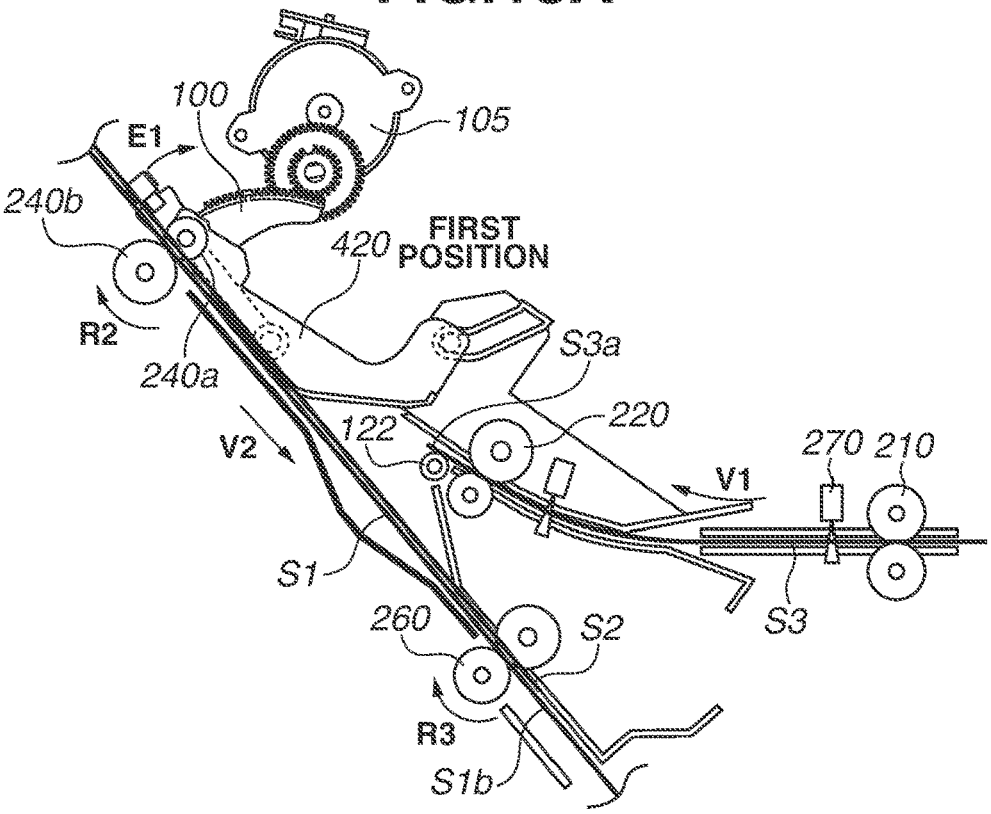
FIG. 18A is a sectional view illustrating the movable guide member according to the first exemplary embodiment.

FIG. 18A illustrates a state where the rotation of the reverse rollers 240 in the rotation direction R2 is started and the superimposed sheets S1 and S2 are delivered to the internal discharge rollers 260. The internal discharge rollers 260 receive the sheets S1 and S2 in a state where the internal discharge rollers 260 are rotating in the rotation direction R3, and convey the sheets S1 and S2 in the forward direction on the internal discharge path 820. The sheets S1 and S2 are conveyed in the superimposed state toward the binding processing portion 4A via the internal discharge path 820.

After the leading edge (second edge S2*b*) of the sheet S2 on the internal discharge path 820 passes through the internal discharge rollers 260, the leading edge (first edge S3*a*) of the third sheet S3 on the receiving path 810 reaches the reverse branch rollers 122. Accordingly, the sheets S2 and S3 are conveyed such that the sheets S2 and S2 pass each other at the branch portion of the conveyance path. The reverse upper roller 240*a* is moved in the E1 direction after the sheet S2 is nipped by the internal discharge rollers 260, and the reverse rollers 240 are brought into the separated state again before the leading edge of the subsequent sheet S3 reaches the reverse upper guide 420. Accordingly, when the leading edge of the sheet S3 passes through the first discharge path 830, the first discharge path 830 is widened, which makes it possible to convey the sheet S3 without causing a jam.

Figure 18B:
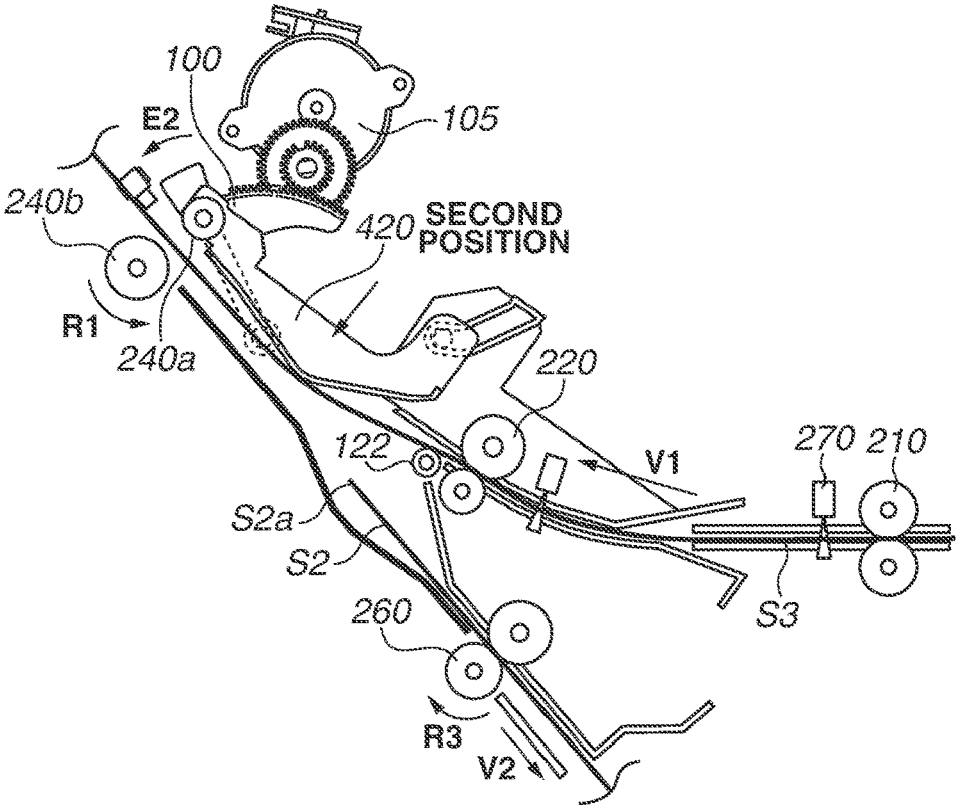
FIG. 18B is a sectional view illustrating the movable guide member according to the first exemplary embodiment.

FIG. 18B illustrates a state where the state of the reverse rollers 240 is changed from the separated state to the contact state. The state of the reverse rollers 240 is changed from the separated state to the contact state after the first edge S2*a* of the sheet S2 is separated from the reverse rollers 240, and the reverse rollers 240 nip the sheet S3. After that, the reverse rollers 240 perform the reverse operation on the sheet S3, and convey the sheet S3 subsequent to the sheets S1 and S2 to the binding processing portion 4A through the internal discharge path 820.

Figure 19:
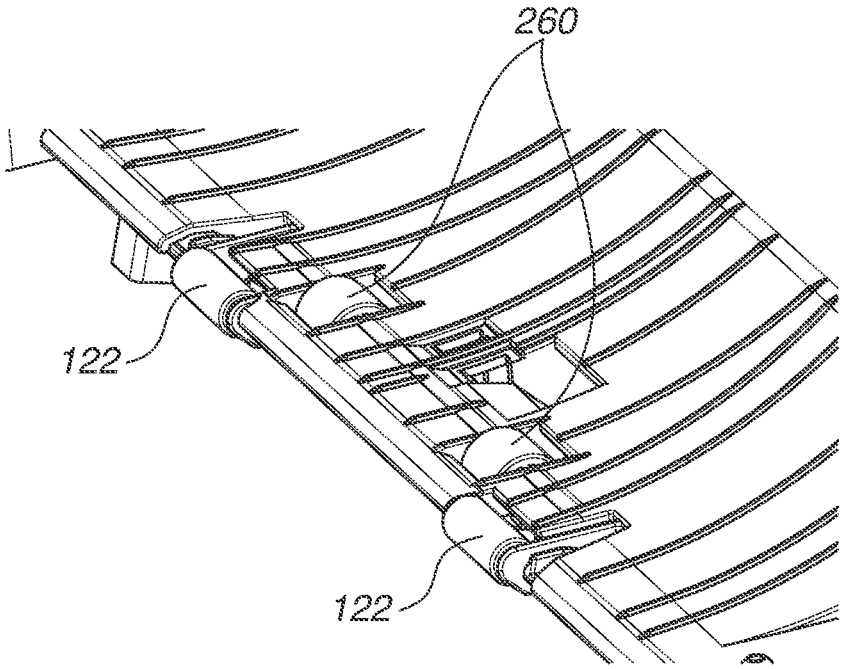
FIG. 19 is a sectional view illustrating a driven rotary member according to the first exemplary embodiment.

When the sheet is conveyed from the receiving path 810 (first conveyance path) toward the first discharge path 830 (second conveyance path), the sheet is pressed against the reverse branch portion 121 (portion provided with the reverse branch rollers 122), which may cause an image damage. The reverse branch rollers 122 are rotatable and are provided to prevent an image damage. FIG. 19 is a perspective view of the reverse branch rollers 122. The reverse branch rollers 122 are provided at two respective locations in the axial direction, and the interval between the reverse branch rollers 122 is set such that even a sheet having a minimum width can pass above the reverse branch rollers 122.

Figure 20:
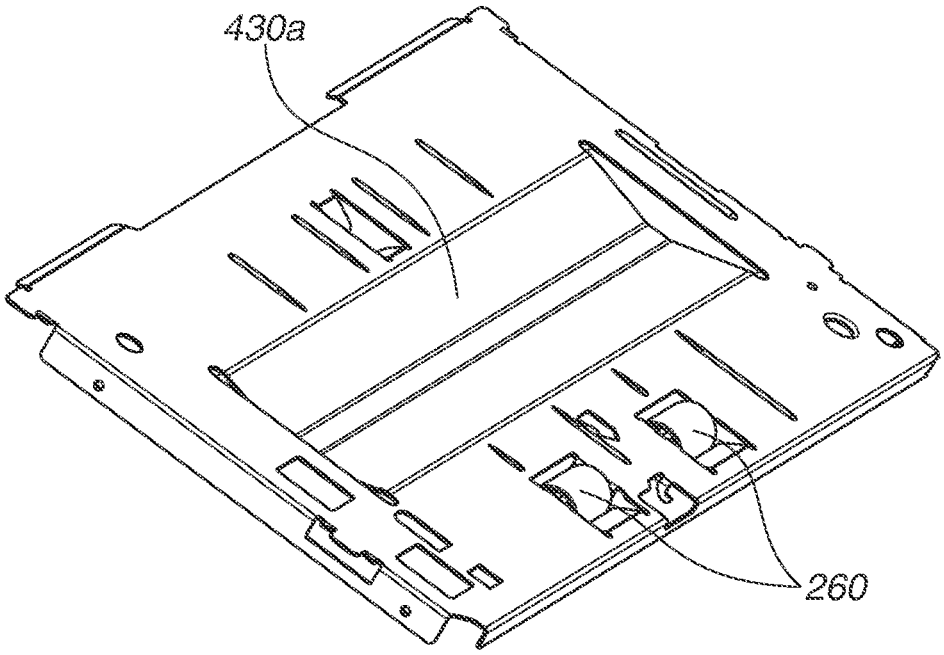
FIG. 20 is a perspective view illustrating a dent portion according to the first exemplary embodiment.

A dent 430*a* in the reverse lower guide 430 illustrated in FIG. 20 is provided to reduce sheet contact sound. After the trailing edge S1*b* of the conveyed sheet has passed through the reverse branch rollers 122 from the state illustrated in FIG. 15A, the sheet swiftly abuts against the reverse lower guide 430. At this time, the provision of the dent 430*a* at the location where the trailing edge of each sheet comes into contact with makes it possible to reduce sheet contact sound.

In the present exemplary embodiment, the position of the reverse upper guide 420 when a sheet is conveyed from the pre-buffer rollers 220 is different from the position of the reverse upper guide 420 when the sheet is reversed and conveyed by the reverse rollers 240, thereby preventing the occurrence of a jam during sheet conveyance.

OTHER EXEMPLARY EMBODIMENTS

In the above-described first exemplary embodiment, the description is given of an example of the mechanism for moving the reverse upper guide 420 of the buffer portion 4B.

The present disclosure is also applicable to, for example, a configuration in which the buffering operation is not performed on sheets in the buffer portion 4B.

In this case, the buffer portion 4B functions as a reverse portion that reverses one sheet.

In the above-described first exemplary embodiment, the description is given of an example where the post-processing apparatus 4 that is directly coupled to the image forming apparatus 1 is used as an example of the sheet conveyance apparatus. The present technique is also applicable to any sheet conveyance apparatus that receives and conveys a sheet from the image forming apparatus 1 via an intermediate unit (e.g., a relay conveyance unit mounted in a discharge space in an internal discharge-type image forming apparatus).

Examples of the image forming system 1S including the sheet conveyance apparatus and the image forming apparatus 1 include an image forming system in which modules including the functions of the image forming apparatus 1 and the post-processing apparatus 4 are mounted in a single housing.

The stapler described above is an example of a processing unit that processes sheets. For example, a bundle of sheets aligned in an intermediate stacking portion may be discharged onto the lower discharge tray 37 in a state where the sheets are not bound. The post-processing apparatus 4 described in the above exemplary embodiment is an example of the sheet conveyance apparatus that conveys sheets. The present exemplary embodiment is also applicable to any sheet conveyance apparatus other than the post-processing apparatus that processes a sheet (recording material) on which an image is formed in the image forming apparatus 1.

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described Embodiments and/or that includes one or more circuits (e.g., application specific integrated circuit (ASIC)) for performing the functions of one or more of the above-described Embodiments, and by a method performed by the computer of the system or apparatus by, for example, reading out and executing the computer executable instructions from the storage medium to perform the functions of one or more of the above-described Embodiments and/or controlling the one or more circuits to perform the functions of one or more of the above-described Embodiments. The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-082096, filed May 19, 2022, which is hereby incorporated by reference herein in its entirety.

What is claimed is:

1. A sheet conveyance apparatus comprising:

a first conveyance path for receiving a sheet;

a first conveyance roller pair for conveying the sheet;

a reverse roller pair configured to reverse the sheet having passed through the first conveyance path;

a second conveyance path for conveying the sheet having passed through the first conveyance path between the reverse roller pair and the first conveyance path;

a second conveyance roller pair configured to nip and convey the sheet reversed on the second conveyance path by the reverse roller pair;

a first conveyance guide located between the reverse roller pair and the second conveyance roller pair, the first conveyance guide forming the second conveyance path;

a second conveyance guide located at a position opposing the first conveyance guide between the reverse roller pair and the second conveyance roller pair, wherein the second conveyance guide forms the second conveyance path;

a third conveyance guide including a driven rotary member configured to rotate in contact with the sheet; and a holder configured to movably support the first conveyance guide, wherein the first conveyance guide is configured to move between a first position located at a first distance from the second conveyance guide and a second position located at a second distance greater than the first distance, wherein the sheet reversed by the reverse roller pair is conveyed toward the second conveyance roller pair by the first conveyance guide located at the first position, and wherein the driven rotary member is located at a downstream side of the first conveyance roller pair and at an upstream side of the first conveyance guide, and the third conveyance guide forms the first conveyance path together with the holder.

2. The sheet conveyance apparatus according to claim 1, wherein the second conveyance path is configured to extend below the first conveyance path.

3. The sheet conveyance apparatus according to claim 2, wherein the holder includes a first conveyance unit at a downstream side of the first conveyance path in a first direction in which the sheet is conveyed through the first conveyance path.

4. The sheet conveyance apparatus according to claim 3, further comprising a first stacking unit on which the sheet discharged from the reverse roller pair is discharged, wherein the first stacking unit is located at a downstream side of the reverse roller pair in the first direction, and the reverse roller pair is configured to discharge the sheet onto the first stacking unit.

5. The sheet conveyance apparatus according to claim 3, further comprising separation levers configured to move the first conveyance guide at a predetermined timing, wherein the first conveyance unit conveys the sheet toward the reverse roller pair, and wherein, in a case where a leading edge of the sheet is conveyed by the first conveyance unit, the first conveyance guide moved by the separation levers is located at the second position.

6. The sheet conveyance apparatus according to claim 5, wherein the sheet reaches the reverse roller pair before a trailing edge of the sheet is conveyed by the first conveyance unit, and wherein the separation levers move the first conveyance guide from the second position to the first position before the trailing edge of the sheet is conveyed by the first conveyance unit.

7. The sheet conveyance apparatus according to claim 6, wherein, after the trailing edge of the sheet is conveyed by the first conveyance unit, the reverse roller pair conveys the sheet in a second direction opposite to the first direction and allows the sheet to reach the second conveyance roller pair.

8. The sheet conveyance apparatus according to claim 7, wherein the second conveyance guide includes a dent portion at an upstream side of the second conveyance roller pair in the second direction.

9. The sheet conveyance apparatus according to claim 7, further comprising:

a second stacking unit on which the sheet conveyed by the second conveyance roller pair is stacked, wherein the second stacking unit is located at a downstream side of the second conveyance roller pair in the second direction; and a processing unit configured to perform binding processing on the sheet stacked on the second stacking unit.

10. A sheet conveyance apparatus comprising:

a first conveyance path for receiving a sheet;

a reverse roller pair configured to reverse the sheet having passed through the first conveyance path;

a second conveyance path for conveying the sheet having passed through the first conveyance path between the reverse roller pair and the first conveyance path;

a conveyance roller pair configured to nip and convey the sheet reversed on the second conveyance path by the reverse roller pair;

a first conveyance guide located between the reverse roller pair and the conveyance roller pair, the first conveyance guide forming the second conveyance path;

a second conveyance guide located at a position opposing the first conveyance guide between the reverse roller pair and the conveyance roller pair, wherein the second conveyance guide forms the second conveyance path; and a holder configured to movably support the first conveyance guide, wherein the first conveyance guide is configured to move between a first position located at a first distance from the second conveyance guide and a second position located at a second distance greater than the first distance, wherein the sheet reversed by the reverse roller pair is conveyed toward the conveyance roller pair by the first conveyance guide located at the first position, wherein the reverse roller pair includes a first reverse roller and a second reverse roller that are configured to nip the sheet, wherein the first conveyance guide includes the first reverse roller, and wherein the first reverse roller is in contact with the second reverse roller in a case where the first conveyance guide is located at the first position, and the first reverse roller is separated from the second reverse roller in a case where the first conveyance guide is located at the second position.

11. An image forming system comprising:

an image forming apparatus configured to form an image on a sheet; and the sheet conveyance apparatus according to claim 10, wherein the sheet conveyance apparatus is configured to receive the sheet from the image forming apparatus and perform processing on the image forming apparatus sheet.

* * * * *